US005167066A

United States Patent [19]

McEnroe

[11] Patent Number: 5,167,066

[45] Date of Patent: Dec. 1, 1992

[54] METHOD FOR PRODUCING AN INSULATED ELECTRICAL CONNECTOR

[75] Inventor: Stanley R. McEnroe, Kingman, Kans.

[73] Assignee: Mize & Co., Inc., Kingman, Kans.

[21] Appl. No.: 744,113

[22] Filed: Aug. 8, 1991

[51] Int. Cl.[5] ..... H01R 4/18

[52] U.S. Cl. ..... 29/882; 29/876; 439/877

[58] Field of Search ..... 29/857, 861, 863, 874, 29/876, 882; 439/937, 883, 892, 750, 877-882

[56] References Cited

U.S. PATENT DOCUMENTS

| | | | |
|---|---|---|---|
| 2,721,986 | 10/1955 | Badeau | 339/217 |
| 3,356,987 | 12/1967 | Gillespie | 339/223 |
| 3,512,123 | 5/1970 | Costello et al. | 339/276 |
| 3,550,856 | 12/1970 | Wise et al. | 439/937 X |
| 3,605,077 | 9/1971 | Kaylor | 339/223 |
| 3,774,141 | 11/1973 | Cordon | 439/937 X |
| 4,298,243 | 11/1981 | Swengel, Jr. | 339/276 F |
| 4,813,893 | 3/1989 | Sindlinger | 29/882 X |
| 5,017,161 | 5/1991 | Hauchard et al. | 439/750 |

FOREIGN PATENT DOCUMENTS

| | | | |
|---|---|---|---|
| 594662 | 3/1960 | Canada | 29/882 |

OTHER PUBLICATIONS

Chi der Automatic Machine Company Handbook to Chi der Automatic Machine Co. of Taiwan, admitted prior art (prior to 1990), 6 printed pages & 22 Figures. Three (3) Pictures Illustrating & Picturing the Chi der Automatic Machine (prior art).

*Primary Examiner*—Timothy V. Eley
*Attorney, Agent, or Firm*—John Wade Carpenter

[57] ABSTRACT

A method for producing a tubular insulator comprising providing a tubular insulator including a longitudinal tubular structure defining a first tubular end, a second tubular end and a central tubular structure between the first tubular end and the second tubular end. The longitudinal tubular structure further defines a longitudinal bore having a generally uniform first internal diameter generally throughout the longitudinal tubular structure including through the first tubular end and through the central tubular structure and through the second tubular end. The method further comprises flaring the first internal diameter of the longitudinal bore in the first tubular end into a second internal diameter that is larger than the first internal diameter to produce a tubular insulator including a longitudinal tubular structure defining the first tubular end having a longitudinal bore with the second internal diameter, and the central tubular structure and the second tubular end both having the longitudinal bore with the first internal diameter. The method still further includes flaring the first internal diameter of the longitudinal bore in the second tubular end into a third internal diameter that is larger than the second internal diameter of the first tubular end to produce a tubular insulator comprising a longitudinal tubular structure defining the first tubular end having the longitudinal bore with the second internal diameter, the central tubular structure having the longitudinal bore with the first internal diameter, and the second tubular end having a longitudinal bore with the third internal diameter.

46 Claims, 26 Drawing Sheets

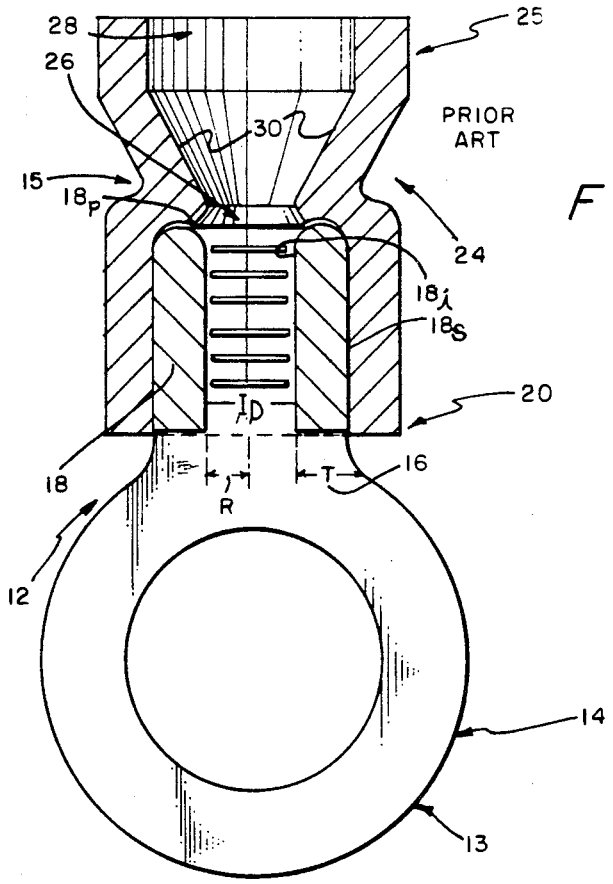
FIG. 9
FIG. 10
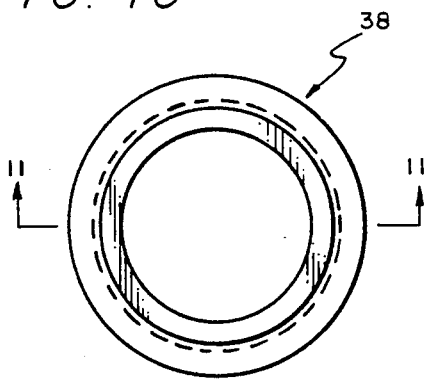
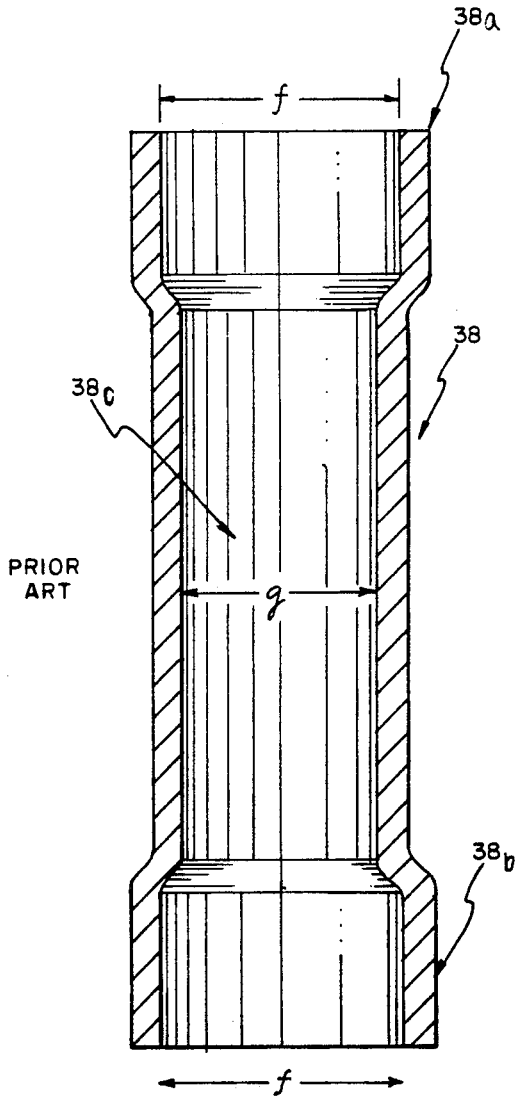
FIG. 11

FIG. 12
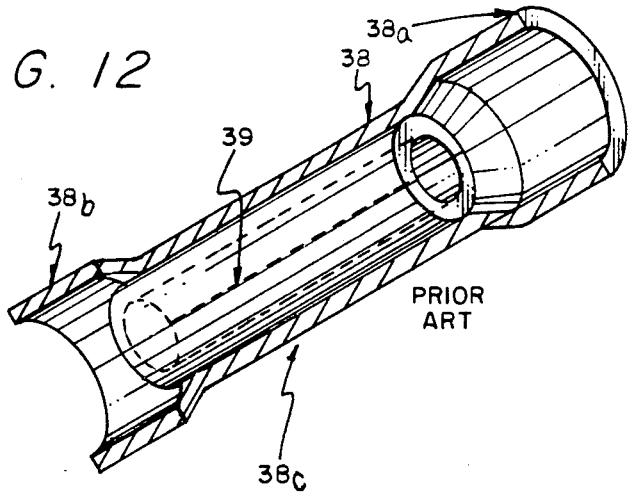
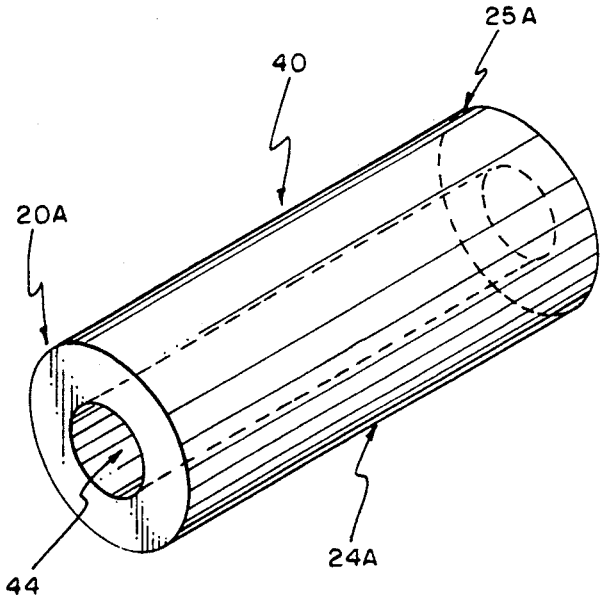
FIG. 13
FIG. 15
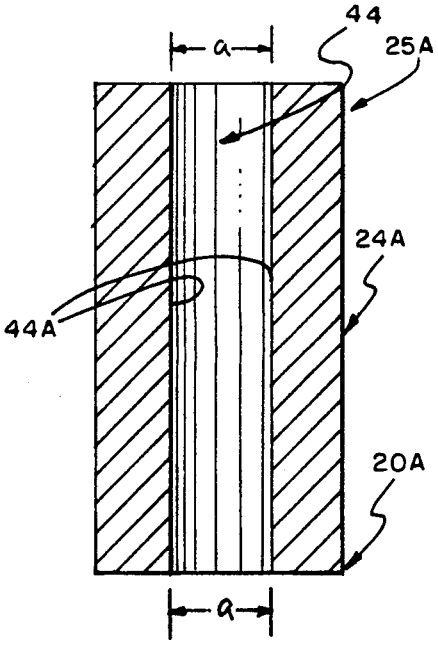
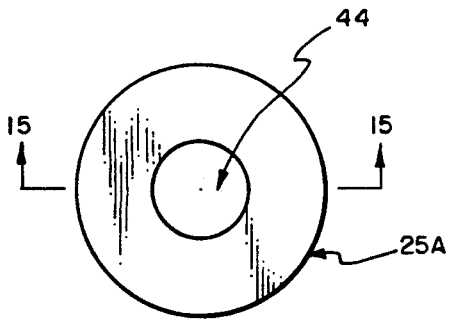
FIG. 14

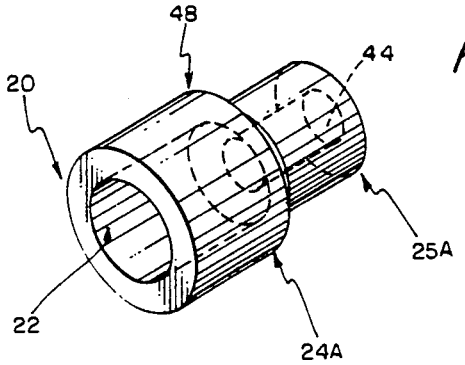
FIG. 16
FIG. 17
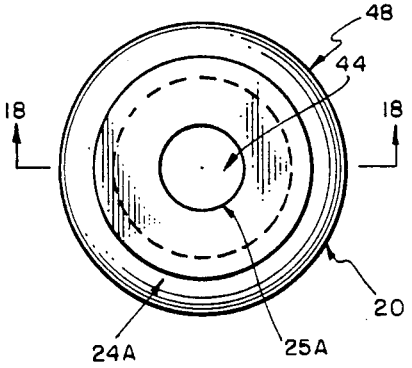
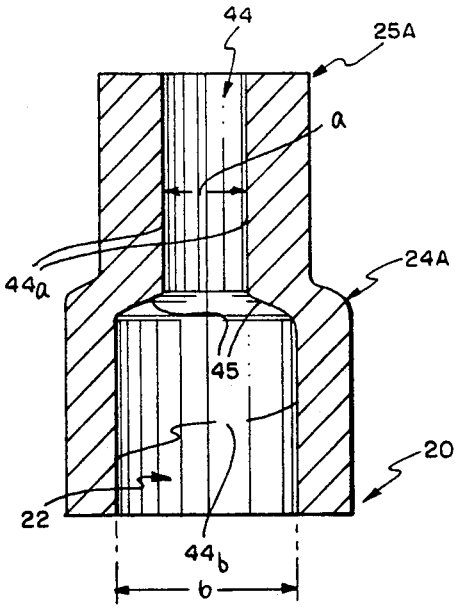
FIG. 18
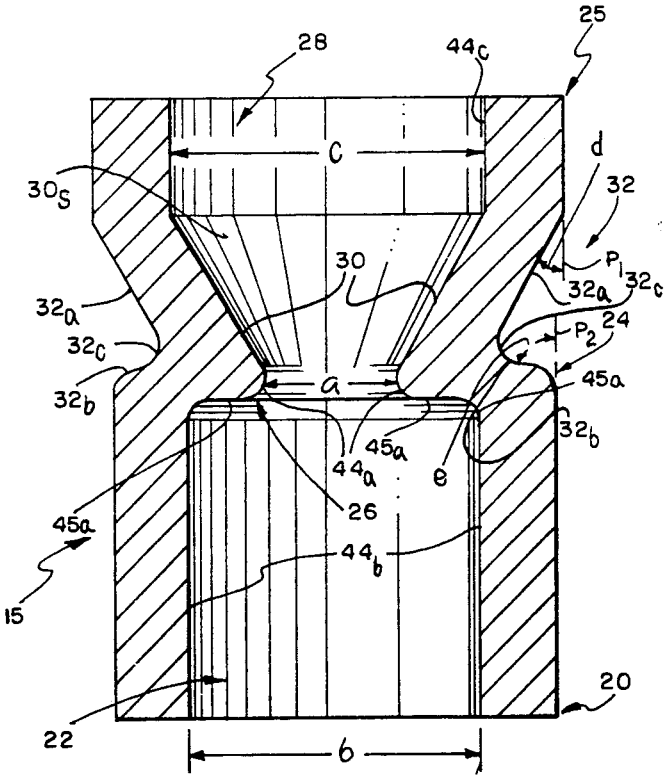
FIG. 19

FIG. 33
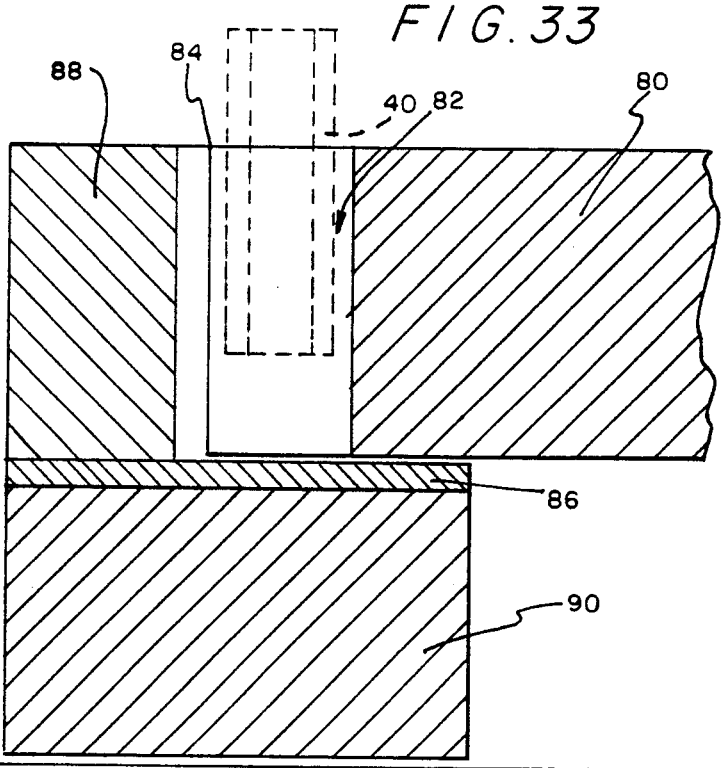
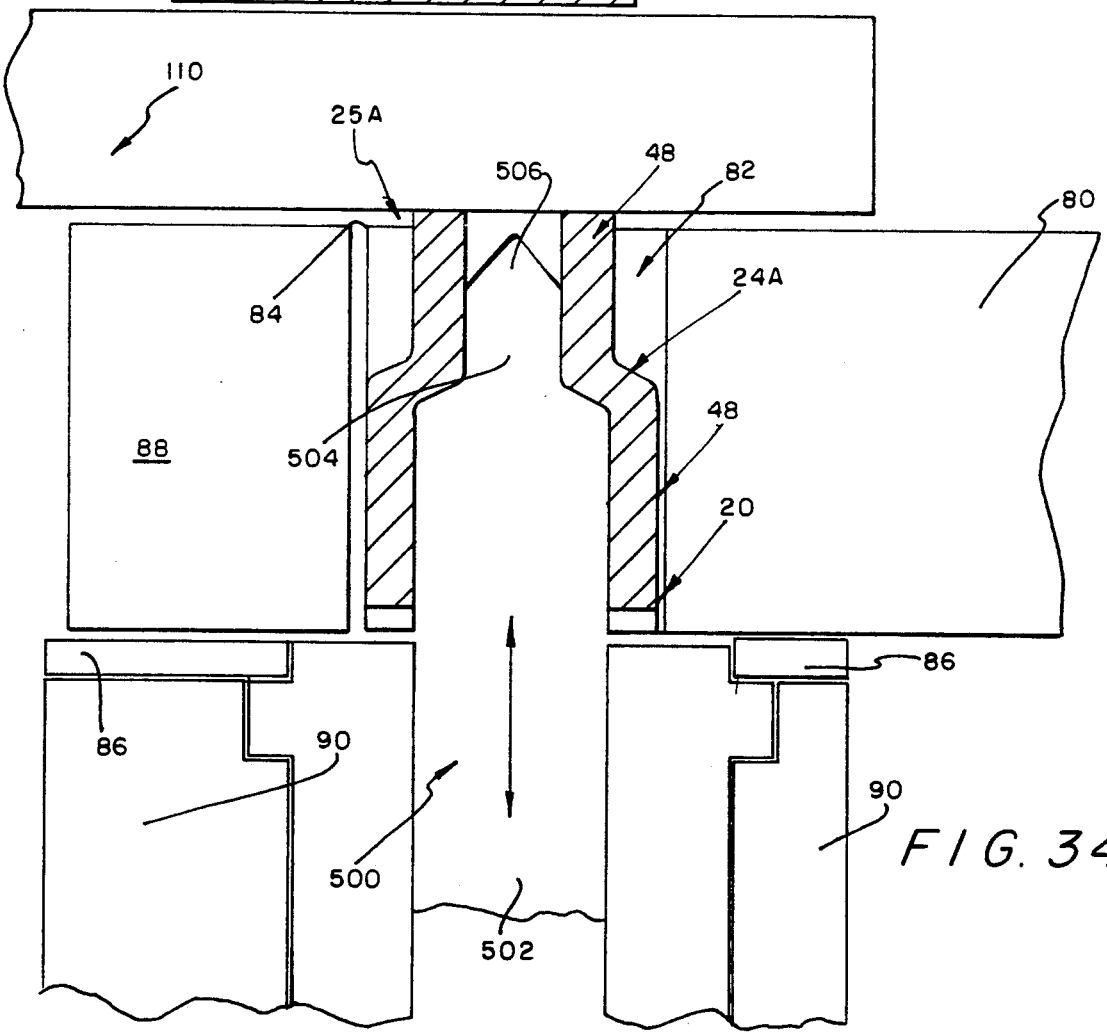
FIG. 34

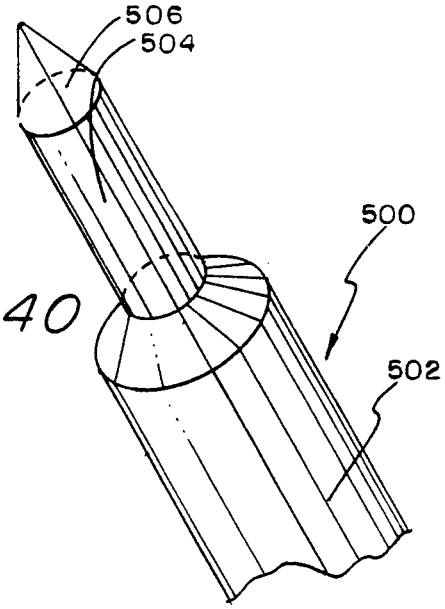
FIG. 40
FIG. 41
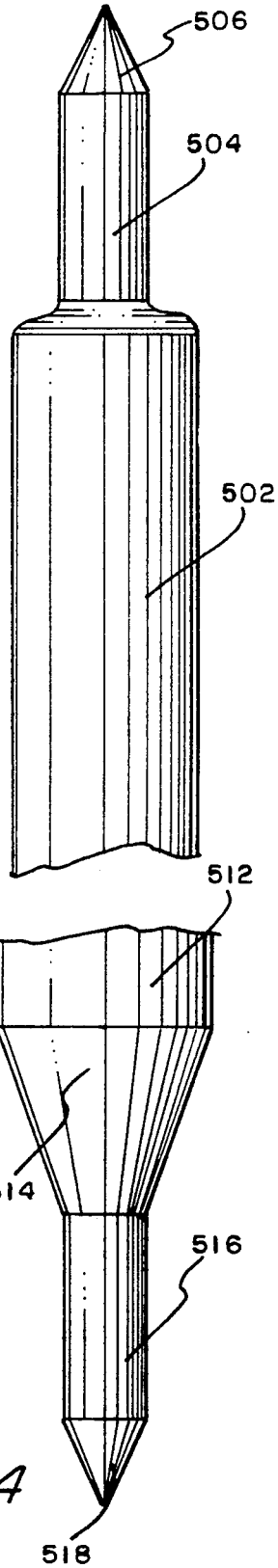
FIG. 42
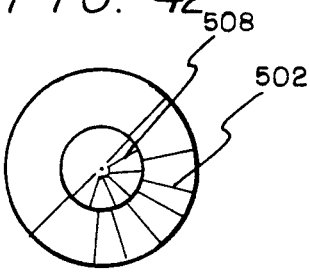
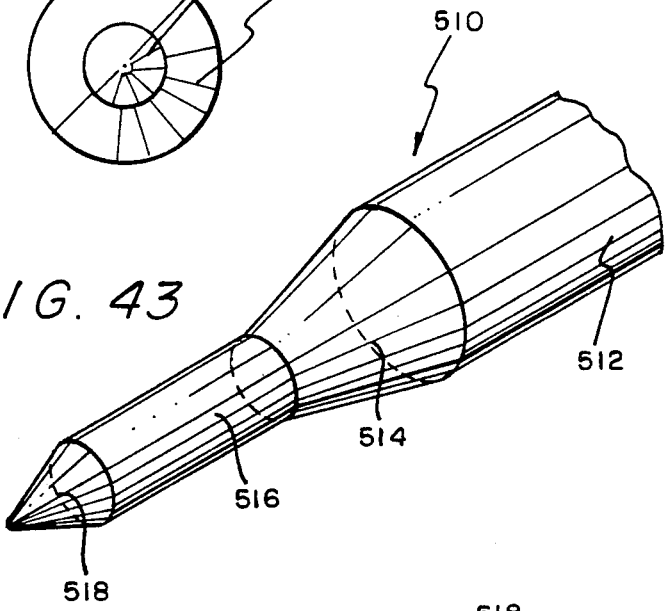
FIG. 43
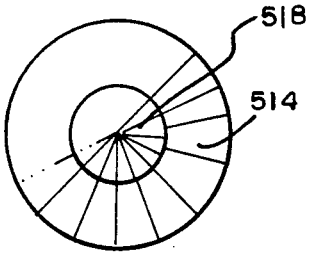
FIG. 45
FIG. 44

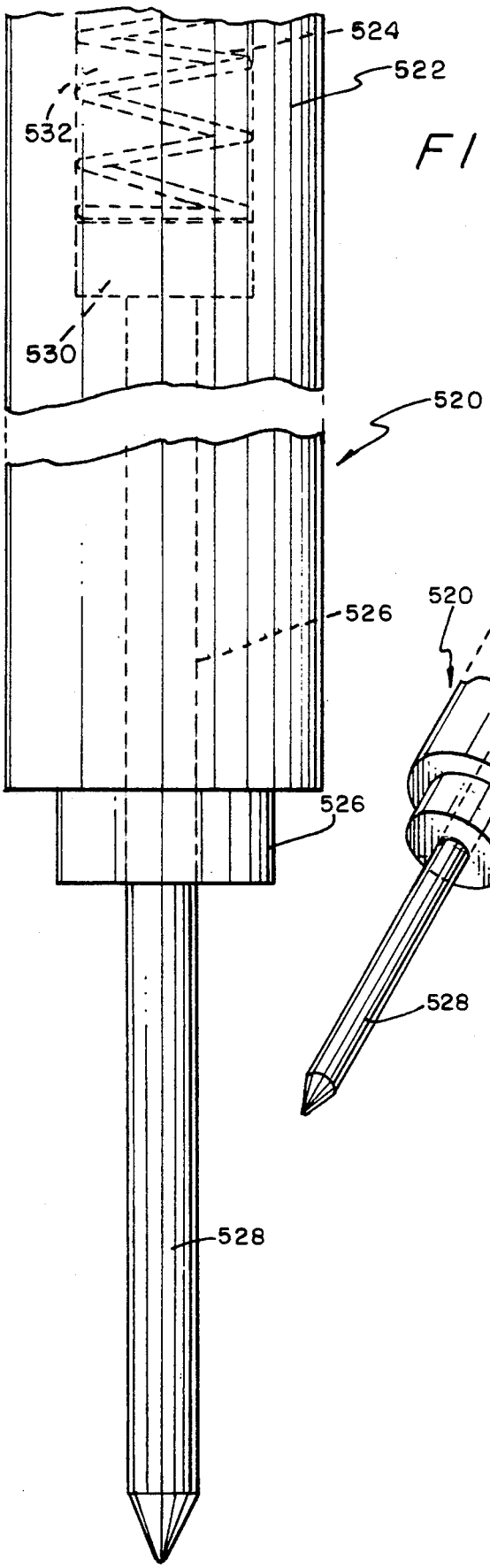
FIG. 47
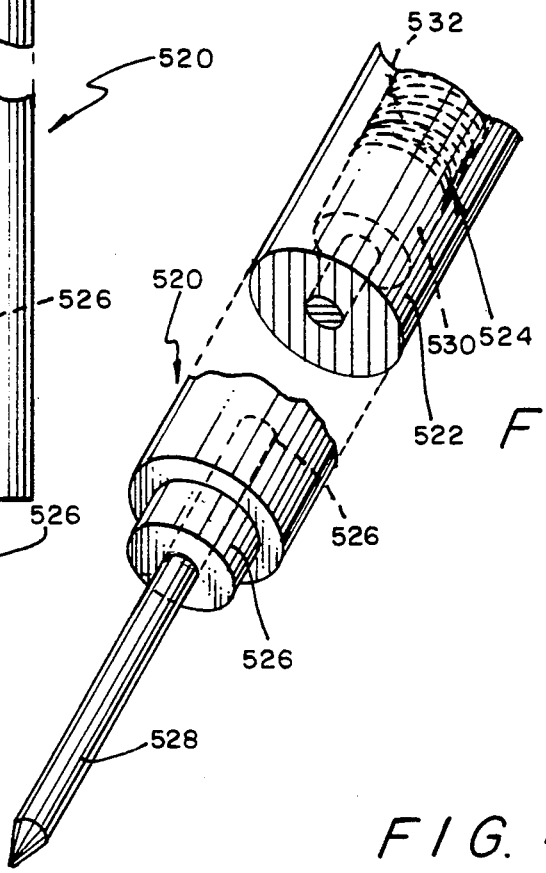
FIG. 46
FIG. 48
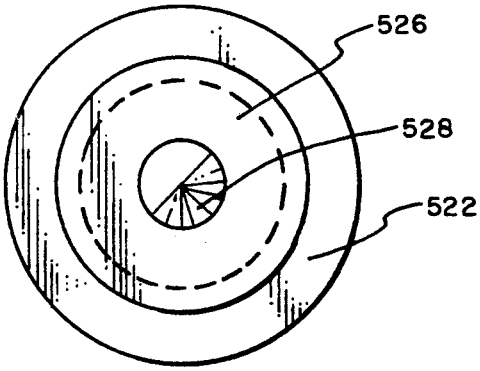

METHOD FOR PRODUCING AN INSULATED ELECTRICAL CONNECTOR

BACKGROUND OF THE INVENTION

1. Field of the Invention

This invention is related to a tubular insulator. More specifically, this invention provides for an apparatus and method for producing an insulated electrical connector.

2. Description of the Prior Art

A patentability investigation was conducted and the following U.S. patents were discovered: U.S. Pat. Nos. 2,721,986 to Badeau; 3,356,987 to Gillespie; 3,512,123 to Costello et al.; 3,605,077 to Kaylor; and 4,298,243 to Swengle, Jr. et al.

U.S. Pat. No. 2,721,986 to Badeau teaches a self-insulated electrical connector molded from a plastic material, such as nylon.

U.S. Pat. No. 3,356,987 to Gillespie teaches an insulation support and wire guide for an electrical connector. More particularly, a terminal is provided and the terminal has a funneling means to guide the wire into place in the terminal.

U.S. Pat. No. 3,512,123 to Costello et al. teaches a guide and crimp-locating means in electrical connectors and method and apparatus for making same. The electrical connector comprises a dielectric part formed from a suitable plastic material such as, for example, polyvinyl chloride, nylon or the like which is susceptible to cold-forming techniques.

U.S. Pat. No. 3,605,077 to Kaylor teaches electrical terminals of the type used to connect lead wires to electrical components. More particularly, an electrical terminal is provided with wire guides and wire stops for properly locating the lead wires relative to the terminal wire barrels.

U.S. Pat. No. 4,298,243 to Swengel, Jr. et al. teaches a pre-insulated flag-type terminal. More particularly, this patent teaches a flag-type pre-insulated terminal device for the type which are intended for crimping onto the end of an insulated wire to produce a fully insulated termination of the wire end.

None of the foregoing U.S. patents, all of which are fully incorporated herein by reference thereto, teach or suggest the particular apparatus and method of the present invention.

SUMMARY OF THE INVENTION

The present invention accomplishes its desired objects by broadly providing a method for producing a tubular insulator comprising the steps of:

(a) providing a tubular insulator including a longitudinal tubular structure defining a first tubular end, a second tubular end, a central tubular structure between the first tubular end and the second tubular end, and a longitudinal bore having a generally uniform first internal diameter generally throughout the longitudinal tubular structure including through the first tubular end and through the central tubular structure and through the second tubular end;

(b) flaring the first internal diameter of the longitudinal bore in the first tubular end into a second internal diameter that is larger than the first internal diameter to produce a tubular insulator including a longitudinal tubular structure defining the first tubular end having a longitudinal bore with the second internal diameter, and the central tubular structure and the second tubular end both having the longitudinal bore with the first internal diameter; and (c) flaring the first internal diameter of the longitudinal bore in the second tubular end into a third internal diameter that is larger than the second internal diameter of the first tubular end to produce a tubular insulator including a longitudinal tubular structure defining the first tubular end having the longitudinal bore with the second internal diameter, the central tubular structure having the longitudinal bore with the first internal diameter, and the second tubular end having a longitudinal bore with the third internal diameter.

The method additionally comprises providing an electrical connector having a terminal barrel, and inserting the terminal barrel into the first terminal end. The flaring step (b) on the tubular insulator of step (a) is performed when the tubular insulator of step (a) is at a first location or station, and the flaring step (c) on the tubular insulator produced in step (b) is performed when the tubular insulator of step (b) is at a second location or station. The first and second location are essentially at the same elevation. The tubular insulator of step (a) includes a longitudinal axis, and the method additionally comprises moving, prior to the flaring step (b), the tubular insulator of step (a) to the first location or station where the longitudinal axis of the tubular insulator is generally vertical. The method further additionally comprises moving, prior to the flaring step (c), the tubular insulator produced by step (b) to the second location or station where the longitudinal axis of the tubular insulator remains generally vertical. Prior to the terminal barrel of the electrical connector being inserted into the flared terminal end of the tubular insulator produced by step (c), the tubular insulator produced in step (c) is moved to a third location or station which is preferably at the essentially same elevation as the first and/or second location or station. At the third location or station, the terminal barrel of the electrical connector is inserted into the flared first terminal end of the tubular insulator produced from step (c).

The moving, prior to the flaring step (b), of the tubular insulator of step (a) to the first station where the longitudinal axis of the tubular insulator is generally vertical comprises disposing the tubular insulator of step (a) in a recess of an alignment wheel such that the longitudinal axis of the tubular insulator of step (a) is generally vertical; and rotating the alignment wheel having the tubular insulator of step (a) disposed in the recess thereof with the longitudinal axis of the tubular insulator of step (a) remaining generally vertical. Similarly, the moving, prior to the flaring step (c), of the tubular insulator of step (b) to the second station where the longitudinal axis of the tubular insulator remains generally vertical comprises disposing the tubular insulator of step (b) in a recess of an alignment wheel such that the longitudinal axis of the tubular insulator of step (b) remains generally vertical; and rotating the alignment wheel having the tubular insulator of step (b) disposed in the recess thereof with the longitudinal axis of the tubular insulator of step (b) remaining generally vertical.

The method additionally comprises disposing, prior to the flaring step (b), the tubular insulator of step (a) in a recess of an alignment wheel such that the longitudinal axis of the tubular insulator of step (a) is generally vertical; rotating, prior to the flaring step (b), the alignment wheel, with the produced step (a) tubular insulator being disposed in the recess of the alignment wheel and while the longitudinal axis of the produced step (a) tubular insulator remains generally vertical, until the tubular insulator of step (a) reaches a first location where the flaring step (b) is performed while the longitudinal axis of the tubular insulator remains generally vertical; rotating, subsequent to the flaring step (b) and prior to the flaring step (c), the alignment wheel, with the produced step (b) tubular insulator remaining disposed in the recess of the alignment wheel and while the longitudinal axis of the produced step (b) tubular insulator remains generally vertical, until the tubular insulator of step (b) reaches a second location which is essentially at the same elevation as the first location and is where the flaring step (b) is performed while the longitudinal axis of the tubular insulator remains generally vertical; and rotating, subsequent to the flaring step (c) and prior to the inserting step, the alignment wheel, with the produced step (c) tubular insulator remaining disposed in the recess of the alignment wheel and while the longitudinal axis of the produced step (c) tubular insulator remains generally vertical, until the tubular insulator of step (c) reaches a third location which is essentially at the same elevation as the second location and is where said inserting step is performed while the longitudinal axis of the tubular insulator remains generally vertical.

The methods of the present invention additionally comprise providing, prior to the flaring step (c), a flare pin comprising a cylindrical pin body having a diameter that would be essentially equal to the third internal diameter of the longitudinal bore in the second tubular end of produced tubular insulator of step (c), and a funnel-shaped pin shoulder integrally bound to the cylindrical pin body, and a cylindrical shaped pin neck integrally bound to the funnel-shaped pin shoulder and having a diameter that would be essentially equal to or a little less than the first internal diameter of the longitudinal bore through the central tubular structure and the second tubular end of the produced tubular insulator of step (b), and a conical shaped pin head bound to the cylindrical shaped pin neck. The flaring step (c) comprises passing the cylindrical shaped pin neck and the conical shaped pin head into and through the longitudinal bore of the central tubular structure and the second tubular end of the produced tubular insulator of step (b) and passing the funnel-shaped pin shoulder and the cylindrical pin body into the longitudinal bore of the second tubular end of the produced tubular insulator of step (b) until the conical shaped pin head extends into the longitudinal bore of the first tubular end of the produced tubular insulator of step (b). The flaring step (c) additionally comprises passing the funnel-shaped pin shoulder and the cylindrical pin body into the longitudinal bore of the second tubular end of the produced tubular insulator of step (b) until the conical shaped pin head and the cylindrical shaped pin neck extend into the longitudinal bore of the first tubular end of the produced tubular insulator of step (b).

The present invention further accomplishes its desired objects by broadly providing a method for producing an insulated connector.

The method comprises:

(a) providing an electrical connector comprising a hollow terminal barrel having an outside diameter and including a barrel wall comprising an outside cylindrical surface and an internal cylindrical surface having an internal radius with an internal radius value and with the distance between the internal cylindrical surface and the outside cylindrical surface defining a wall thickness distance;

(b) providing a tubular insulator including a longitudinal tubular structure defining a first tubular end and a second tubular end and a longitudinal bore having an internal bore diameter less than the outside diameter of the terminal barrel and having an internal bore radius with a value ranging from a value less than the internal radius value of the electrical connector in step (a) to about a value equal to the internal radius value plus about 0.80 times the wall thickness distance of the electrical connector in step (a);

(c) flaring the first tubular end of the tubular insulator;

(d) forming a funnel-shaped opening in the second tubular end of the tubular insulator; and (e) inserting the hollow terminal barrel of the electrical connector into the flared first tubular end of the tubular insulator to produce an insulated electrical connector.

The funnel-shaped opening in the second tubular end comprises an inwardly tapering bore terminating in a bore opening having a bore radius essentially equal to the internal bore radius of the tubular insulator.

The present invention still further accomplishes its desired objects by broadly providing a method for producing an insulated electrical connector comprising the steps of:

(a) providing an electrical connector comprising a hollow terminal barrel having an internal diameter an outside diameter;

(b) providing a tubular insulator including a longitudinal tubular structure defining a first tubular end, a second tubular end and a longitudinal bore having an internal bore diameter that is essentially equal to the internal diameter of the terminal barrel or less than the outside diameter of the terminal barrel;

(c) flaring the first tubular end of the tubular insulator;

(d) forming in the second tubular end a funnel-shaped opening comprising an inwardly tapering bore terminating in a bore opening having a bore diameter that is essentially equal to the internal bore diameter of the tubular insulator; and (e) inserting the hollow terminal barrel of the electrical connector into the flared first tubular end such that the bore opening is coaxial with the hollow terminal barrel to produce as insulated electrical connector.

A tubular insulator is claimed produced in accordance with the immediate foregoing steps (a)–(e).

The present invention still further accomplishes its desired objects by broadly providing an apparatus for producing an insulated connector. A combination of a tubular insulator, an electrical connector and the apparatus for producing an insulated connector is provided. The combination comprises:

(a) an electrical connector comprising a hollow terminal barrel having an internal diameter;

(b) a tubular insulator including a longitudinal tubular structure defining a first tubular end, a second tubular end, and a longitudinal bore having an internal bore diameter that is essentially equal to the internal diameter of the terminal barrel;

(c) means for engaging the tubular insulator of paragraph (b);

(d) a means, cooperating with the means for engaging of paragraph (c), for flaring the first tubular end of the tubular insulator of paragraph (b);

(e) a means, cooperating with the means for engaging of paragraph (c), for forming in the second tubular end of the tubular insulator of paragraph (b) a funnel-shaped opening comprising an inwardly tapering bore terminating in a bore opening having a bore diameter that is essentially equal to the internal bore diameter of the tubular insulator;

(f) a means, cooperating with the means for engaging of paragraph (c), for feeding the electrical connector of paragraph (a) to the means for engaging of paragraph (c);

(g) cooperating with the for engaging of paragraph (c), for inserting the hollow terminal barrel of the electrical connector of paragraph (a) into the flared tubular end of the tubular insulator.

These, together with the various ancillary objects and features which will become apparent to those skilled in the art as the following description proceeds, are attained by this novel apparatus and method, a preferred embodiment being shown with reference to the accompanying drawings, by way of example only, wherein:

BRIEF DESCRIPTION OF THE DRAWINGS

FIG. 9 is a partial vertical sectional view of the insulated electrical connector produced with the apparatus of FIGS. 1 and 3;

FIG. 10 is a top plan view of a prior art tubular insulator;

FIG. 11 is a vertical sectional view taken in direction of the arrows and along the plane of line 11—11 in FIG. 10;

FIG. 12 is a partial perspective view of a prior art insulated butt connector;

FIG. 13 is a perspective view of a tubular member which is to be flared at both ends to produce the tubular insulator of this invention;

FIG. 14 is a top plan view of the tubular insulator of FIG. 14;

FIG. 15 is a vertical sectional view taken in direction of the arrows and along the plane of line 15—15 in FIG. 14;

FIG. 16 is a perspective view of the tubular member of FIG. 13 after being flared at one end;

FIG. 17 is a top plan view of the tubular member of FIG. 16;

FIG. 18 is a vertical sectional view taken in direction of the arrows and along the plane of line 18—18 in FIG. 17;

FIG. 19 is an enlarged vertical sectional of the vertical sectional view in FIG. 6;

FIG. 33 is a vertical sectional view taken in direction of the arrows and along the plane of line 33—33 in FIG. 26;

FIG. 34 is a vertical sectional view taken in direction of the arrows and along the plane of line 34—34 in FIG. 26;

FIG. 40 is a partial perspective view of a bottom flare pin;

FIG. 41 is a partial side elevational view of a bottom flare pin;

FIG. 42 is a top plan view of the bottom flare pin on FIG. 41;

FIG. 43 is a partial perspective view of a top flare pin;

FIG. 44 is a partial side elevational view of the top flare pin in FIG. 43;

FIG. 45 is a top plan view of the top flare pin in FIG. 44;

FIG. 46 is a partial perspective view of an assembly pin;

FIG. 47 is a partial side elevational view of the assembly pin in FIG. 46;

FIG. 48 is a top plan view of the assembly pin in FIG. 47;

DETAILED DESCRIPTION OF A PREFERRED EMBODIMENT OF THE INVENTION

Figure 1:
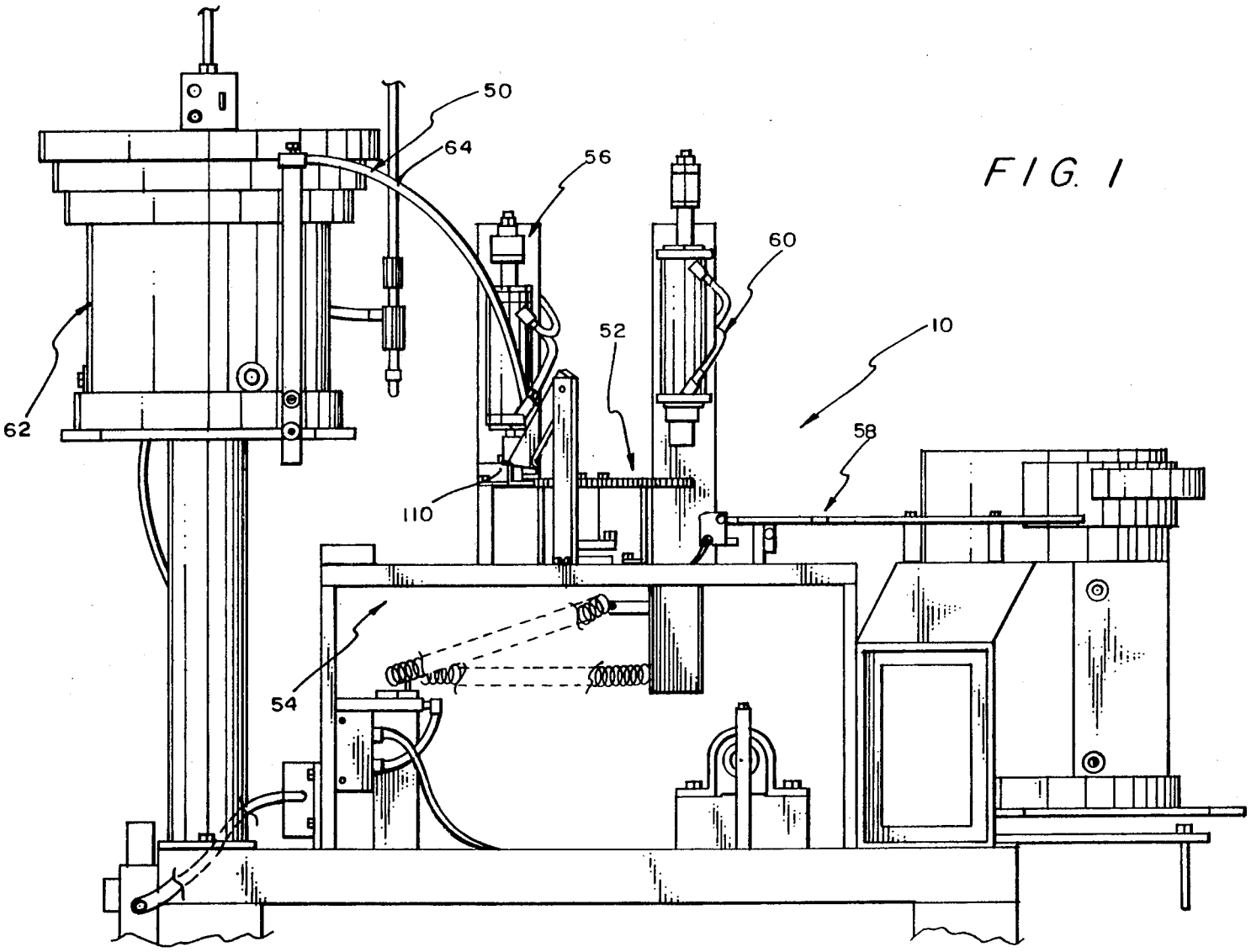
FIG. 1 is a perspective view of the apparatus for producing an insulated electrical connector.
Figure 2:
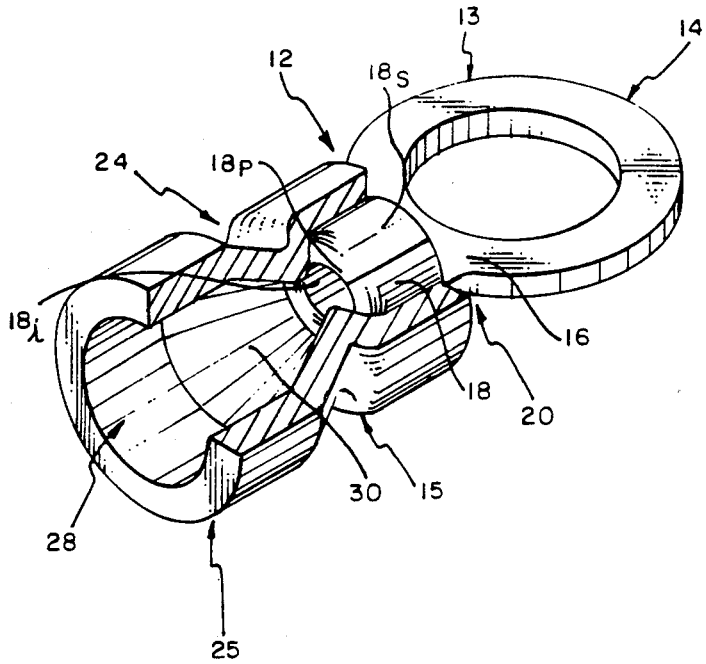
FIG. 2 is a partial perspective view of the insulated electrical connector produced with the apparatus of FIG. 1.
Figure 3:
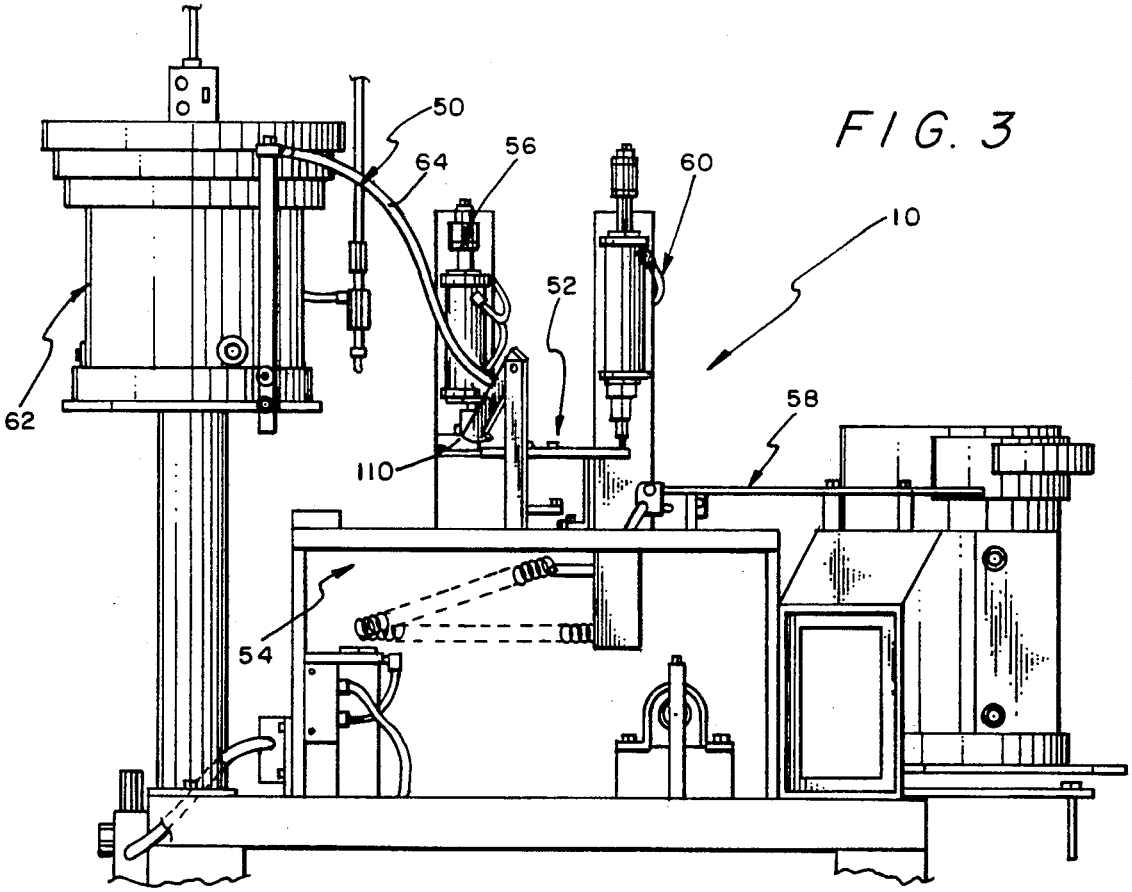
FIG. 3 is another perspective view of the apparatus for producing an insulated electrical connector.

Referring in detail now to the drawings, wherein similar parts of the invention are identified by like reference numerals, there is seen an apparatus, generally illustrated as 10 in FIGS. 1 and 3, for producing an insulated terminal, generally illustrated as 12 and of the type having an electrical connector, generally illustrated as 13, engaged to and protruding from a tubular insulator, generally illustrated as 15 (see FIG. 2). The connector 13 comprises a head, generally illustrated as 14; a neck 16 integrally bound to the head 14; and a hollow barrel 18 integrally bound to the neck 16 and having a leading barrel perimeter 18*p*. The hollow barrel 18 has a generally cylindrical inside surface 18*i* with an internal diameter ID or radius R (see FIG. 9). The hollow barrel 18 also has a generally cylindrical outside surface 18*s* with a certain barrel outside diameter. The generally cylindrical outside surface 18*s* is a generally straight outer surface having no bell-mouth end. The hollow barrel 18 has a thickness value T which is equal to the length or distance between the inside surface 18*i* and the outside surface 18*s* (see FIG. 9). The barrel outside diameter is equal to the internal diameter ID plus 2T. The head 14, the neck 16 and the barrel 18 are preferably formed from a metallic material or substance (e.g. copper) which is capable of conducting electricity. The tubular insulator 15 circumferentially surrounds the barrel 18 and extends away therefrom. The head 14 of the connector 13 may possess any suitable form such as, by way of example only, a ring head 14 (shown in FIG. 2), a hook head 14 (not shown), a spade head 14 (not shown), a blade head 14 (not shown), etc.

Figure 5:
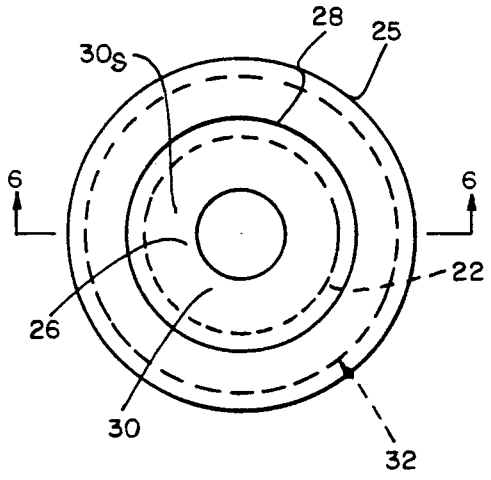
FIG. 5 is a top plan view of the tubular insulator of FIG. 4.
Figure 6:
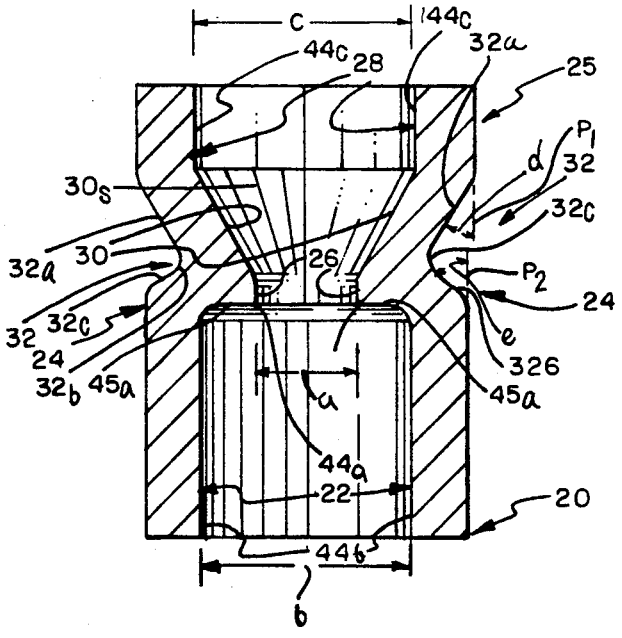
FIG. 6 is a vertical sectional view taken in direction of the arrows and along the plane of line 6—6 in FIG. 5.

The tubular insulator 15 (see FIGS. 4, 5 and 6) is preferably produced or formed from an insulating material, such as a plastic substance (e.g. polyethylene, polypropylene, PVC, etc.). The tubular insulator 15 is not produced through or from injection molding; but is produced by the apparatus 10 of this invention, which performs a series of flaring or expanding steps that will be more fully explained below. The tubular insulator 15 produced by the apparatus 10 of this invention comprises a generally longitudinal tubular structure (see FIGS. 4, 5 and 6) defining a tubular end, generally illustrated as 20 and having a longitudinal bore 22 with an internal diameter b; a central tubular structure, generally illustrated as 24 and having a longitudinal bore 26 with an internal diameter a; and a tubular end, generally illustrated as 25 and having a longitudinal bore 28 with an internal diameter c. Longitudinal bore 28 communicates with a bore 30 that has a hopper or funnel shape with inwardly tapering surfaces 30*s* that terminate in longitudinal bore 26. Longitudinal bore 26 communicates directly with longitudinal bore 22 which is preferably formed to be geometrically cylindrical as best shown in FIG. 6. Thus, the tubular insulator 15 produced by the apparatus 1 of this invention has three separate and distinct internal diameters; namely internal diameters a, b and c. As best shown in FIG. 6 internal diameter b is larger than internal diameter a, and internal diameter c is larger than internal diameter b. Stated alternatively, internal diameter a is smaller than internal diameter b, and internal diameter b is smaller than internal diameter c. The tubular insulator 15 also has the funnel-shaped bore 30 which bridges longitudinal bore 28 with longitudinal bore 26, and provides a funnel entry for an electrical wire into the hollow barrel 18 of the connector 13. As best shown in FIG. 9, the hollow barrel 18 slidably passes into the longitudinal bore 22, and the internal diameter ID or radius R of the hollow barrel is essentially equal to the internal diameter or radius, respectively, of the longitudinal bore 26.

Figure 4:
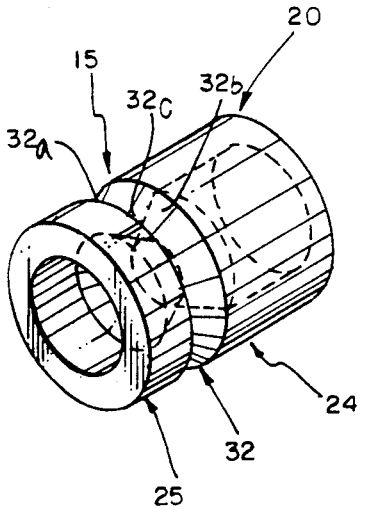
FIG. 4 is a perspective view of the tubular insulator produced with the apparatus of FIGS. 1 and 3.

In one embodiment of the present invention, the tubular insulator 15 produced by the apparatus 10 of this invention has an external shape with a generally arcuate channel or recess, generally illustrated 32 (see FIGS. 4 and 6). The arcuate recess 32 defines an inwardly tapering waist which bridges tubular end 25 with the central tubular structure 24 of the tabulator insulator 15. The arcuate recess 32 circumferentially surrounds the tabulator insulator 15 and comprises a pair of inwardly tapering surfaces 32*a* and 32*b* that meet and terminate in a recess bottom 32*c*. Tapering surface 32*a* tapers inwardly at an angle d from a plane $P_1$ disposed tangentially along the outside surface of the tubular end 25 (see FIG. 6). Tapering surface 32*b* tapers inwardly at an angle e from a plane $P_2$ disposed tangentially along the outside surface of the tubular end 2 (see FIG. 6 again). Angle e is larger than angle d and may range from about 25 degrees to about 80 degrees; and angle d is smaller than angle e and may range from about 10 degrees to about 60 degrees. Stated alternatively, tapering surface 32*b* tapers inwardly more precipitously or acutely away from plane $P_2$ (or at a more precipitous or acute angle e from plane $P_2$) than tapering surface 32*a* tapers from plane $P_1$. Tapering surface 32*a* does not taper away from plane $P_1$ as drastic as tapering surface 32*b* does from plane $P_2$.

Figure 7:
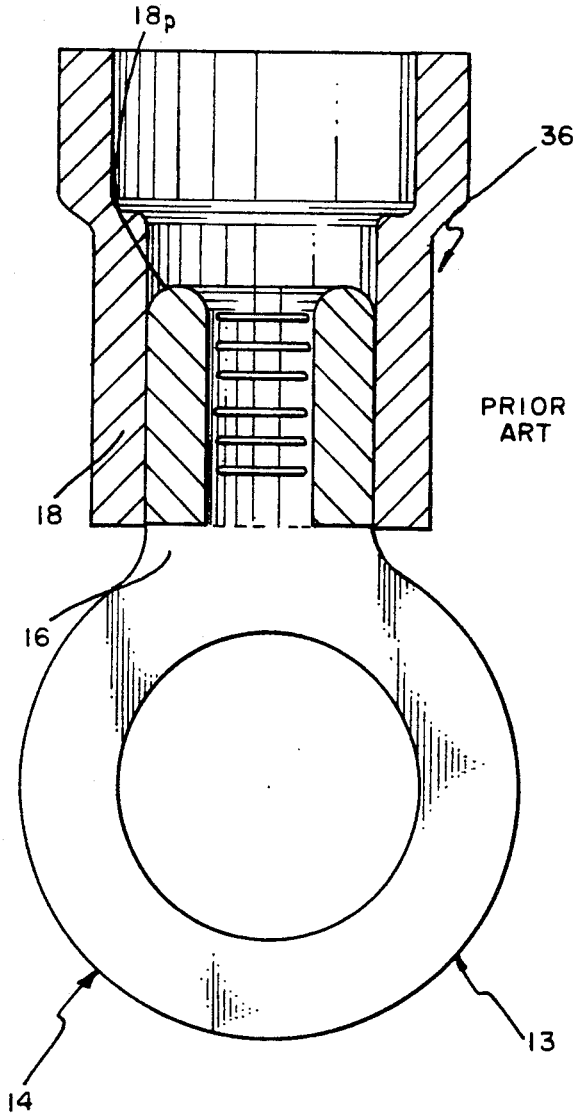
FIG. 7 is a partial vertical sectional view of a prior art insulated electrical connector.
Figure 8:
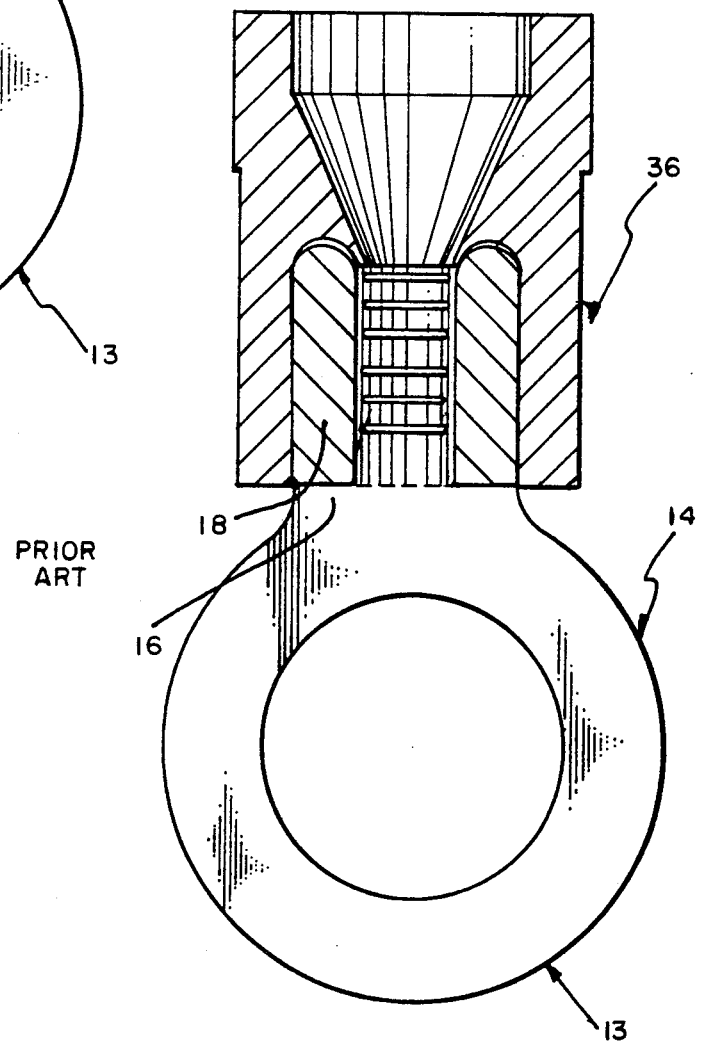
FIG. 8 is a partial vertical sectional view of another prior art insulated electrical connector.
Figure 20:
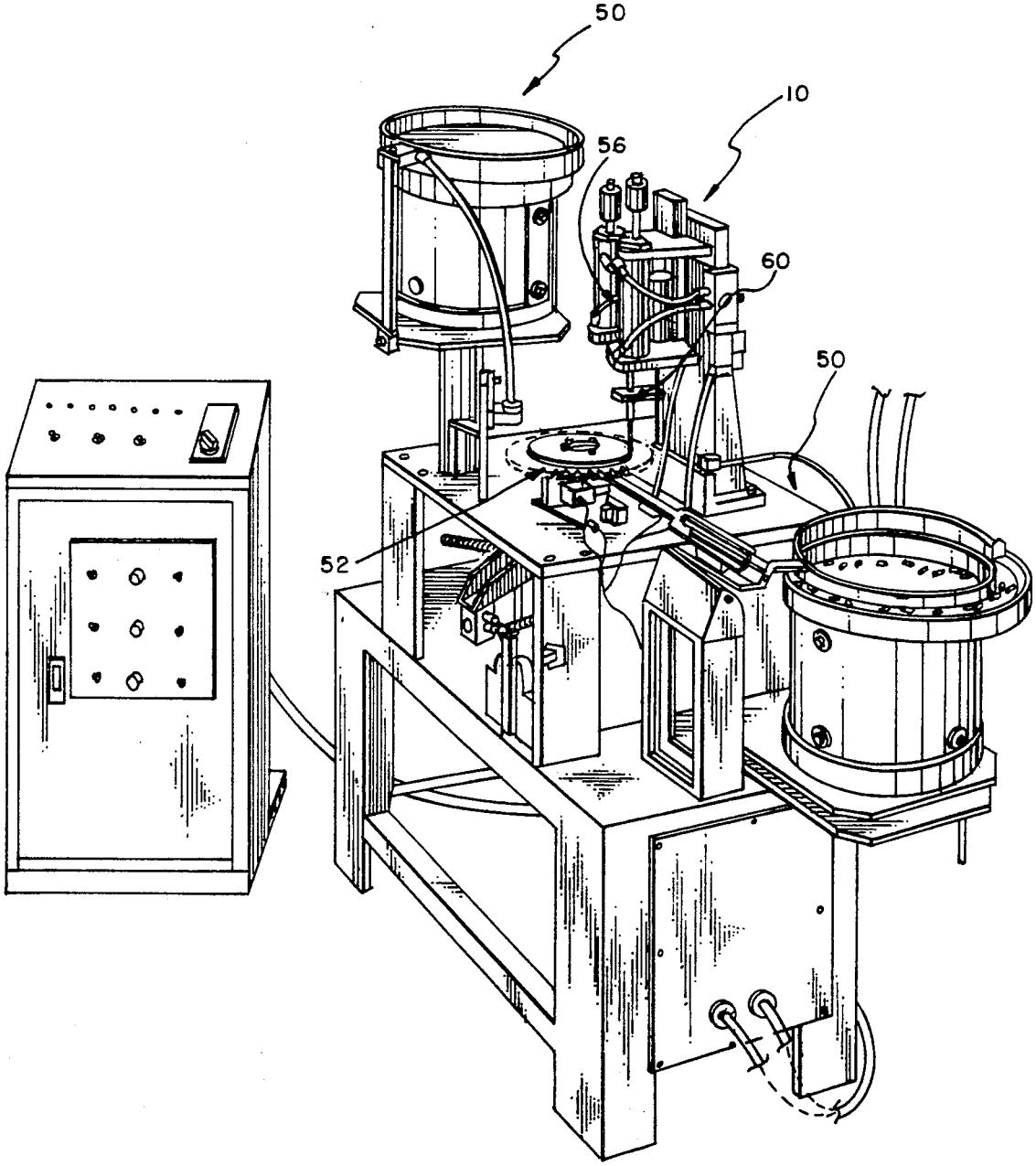
FIG. 20 is another perspective view of the apparatus of FIGS. 1 and 3.

The tubular insulator 15 of this invention is to be contrasted with the tubular insulator, generally illustrated as 36, on each of the prior art insulated terminals illustrated in FIGS. 7 and 8, The prior art tubular insulator 36 on the connector 13 in FIG. 7 has an internal bore surface with two distinct internal diameters; it does not possess in internal bore surface with the three separate and distinct diameters of the tubular insulator 15 produced from the apparatus 10 of the present invention. Nor does the tubular insulator 36 in FIG. feature a funnel entry for a wire into the hollow barrel 18 of the connector 13. The tubular insulator 36 in FIG. 7 also does not possess the arcuate channel or recess 32 that is present in the tubular insulator 15; and when a wire is to be passed through the insulator 36 and into the hollow barrel 18 of the connector 13 in FIG. 7, the wire typically contacts the leading barrel perimeter 18*p* of the hollow barrel 18, preventing the readable passage of the wire into the hollow barrel 18 of the connector 13. The prior art tubular insulator 36 on the connector 13 in FIG. 8 was formed through or from an injection molding process.

The tubular insulator 36 in FIG. 8 does not have the arcuate channel or recess 32. While the injection molding produced tubular insulator 36 in FIG. 8 does possess an internal surface with three distinct internal diameters and a funnel entry for a wire into the hollow barrel 18 of the connector 13, this prior art tubular insulator 36 is costly to manufacture vis-a-vis the tubular insulator 15 produced from or by the apparatus 10 of this invention. As previously indicated, the apparatus 10 produces the tubular insulator 15 through and/or from a series of flaring or expanding steps all of which will be discussed in detail hereinafter.

The tubular insulator 15 of this invention is to be also contrasted with the tubular insulator, generally illustrated as 38, of the prior art insulated butt connector of FIGS. 10, 11 and 12. As best shown in FIGS. 10 and 11, the tubular insulator 38 has a pair of opposed flared or expanded ends 38*a* and 38*b*, both having the same internal diameter f. Between the flared or expanded ends 38*a* and 38*b* is a longitudinal conduit section, generally illustrated as 38*c* and having an internal diameter g which is less than the internal diameter f of the expanded ends 38*a* and 38*b*. A cylindrical metallic conduit, generally illustrated as 39, lodges in the conduit section 38*c* (see FIG. 12) such that the flared or expended ends 38*a* and 38*b* expanded and protrude or project away from the opposed ends of the cylindrical metallic conduit 39. The insulated butt connection of FIG. 12 is for electrically interconnecting two wires (not shown) when the end of the one wire passes through expanded end 38*a* and into the metallic conduit 39 and when the end of the other wire passes through expanded end 38*b* and also into the metallic conduit 39. Stated alternatively, the metallic conduit 39 electrically bridges two electrical wires together such that electricity can flow from one wire into the other wire with the tubular insulator 38 insulating the cylindrical metallic conduit 39.

The tubular insulator 15 is produced by initially providing a longitudinal tubular insulator, generally illustrated as 40 (see FIG. 13), produced from an insulating material (such as plastic) which is to form the tubular insulator 15. The longitudinal tubular insulator 40 includes a longitudinal tubular structure comprising a tubular end, generally illustrated as 20A; a tubular end, generally illustrated as 25A; and a central tubular structure generally illustrated as 24A. The longitudinal tubular insulator 40 also includes a longitudinal bore, generally illustrated as 44, having a cylindrical surface 44*a* with a generally uniform internal diameter a throughout the longitudinal tubular structure including through the tubular end 20A, through the central tubular structure 24A, and through the tubular end 25A.

After the longitudinal tubular insulator 40 has been provided, the tubular end 20A is flared and/or expanded. More specifically, the internal diameter a of the longitudinal bore 44 in and passing through the tubular end 20A is expanded or flared at a first location or station into an internal diameter b that is larger than the internal diameter a to produce a longitudinal tubular insulator, generally illustrated as 48 in FIG. 16. As best shown in FIGS. 16, 17 and 18, the longitudinal tubular insulator 48 comprises a longitudinal tubular structure having the tubular end 20 (i.e. the same tubular end 20 of the tubular insulator 15 in FIG. 6) and including the longitudinal bore, generally illustrated as 22, with a cylindrical surface 44*b* including the internal diameter b. The longitudinal tubular insulator 48 also comprises a longitudinal tubular structure further having the central tubular structure 24A and the tubular end 25A, both having the longitudinal bore 44 with the cylindrical surface 44*a* including the internal diameter a. As best shown in FIG. 18, the cylindrical surface 44*b* terminates in an inwardly tapering cylindrical surface 45 that terminates in the cylindrical surface 44*a*. As further best shown in FIG. 18, the inwardly tapering cylindrical surface 45 tapers inwardly or towards the cylindrical surface 44*a* at an angle less than 90 degrees.

After the longitudinal tubular insulator 48 has been formed, the longitudinal tubular insulator is moved to a second location or station (which is preferably at the same height or elevation as the first location or station where tubular end 20A is expanded or flared) wherein the tubular end 25A is flared and/or expanded. More particularly, the internal diameter a of the longitudinal bore 44 in the tubular end 25A and passing through the tubular end 25A is expanded or flared at the second location or station into an internal diameter c that is larger than the internal diameter b to produce the tubular insulator 15 as depicted in FIG. 19 and in FIG. 6. The tubular insulator 15 comprises a longitudinal tubular structure having the tubular end 20 having the longitudinal bore 22 that has the cylindrical surface 44*b* with the internal diameter b. The tubular insulator 15 in FIG. 19 and in FIG. 6 further comprises a longitudinal tubular structure that has the tubular end 25 which includes the longitudinal bore 28 having a cylindrical surface 44*c* with the internal diameter c. The FIGS. 9 and 19 tubular insulator 15 also has a longitudinal tubular structure including the central tubular structure 24. This central tubular structure 24 has the longitudinal bore 26 with the cylindrical surface 44*a* having the internal diameter a. Inwardly tapering cylindrical surface 45 has been changed or altered into a circular surface 45*a* that is generally normal to the cylindrical surface 44*b*. As previously indicated, the funnel-shaped bore 30 bridges or interconnects longitudinal bore 28 with the longitudinal bore 26. The funnel-shaped bore 30 has the inwardly tapering surface 30*s* that commences with cylindrical surface 44*a*. Longitudinal bore 26 is basically the remnants of longitudinal bore 44 with the same cylindrical surface 44*a*. As further previously indicated, the finally produced tubular insulator 15 includes the arcuate recess 32 which circumferentially surrounds the tabulator insulator 15 and comprises the pair of inwardly tapering surfaces 32*a* and 32*b* that meet and terminate in the recess bottom 32*c*. After the tubular insulator 15 is produced it is moved to a third location or station (which is preferably at the same elevation as the first location or station and/or the second location or station) wherein the longitudinal bore 22 receives the terminal barrel 18 of the connector 13. Stated alternatively, after the tubular insulator 15 is produced, it is moved to a third location or station where the tubular insulator 15 is coupled to the electrical connector 13 by the terminal barrel 18 being slid into the longitudinal bore 22. The terminal barrel 18 has a barrel outside diameter that is slightly larger (preferably 1/128 to 1/16 inch larger) than the internal diameter b in order that the terminal barrel 18 will snugly fit into the longitudinal bore 22.

In another embodiment of the present invention and one of the salient features of the same, the longitudinal tubular insulator 40 is initially provided or produced such that the internal diameter a of the longitudinal bore 44 has a value ranging from a value less than the internal diameter ID of the hollow barrel 18 (e.g. a value equal to about one-half (½) of the internal diameter ID) to about a value equal to the internal diameter ID plus about 1.6 T (where T was previously indicated to be the length or distance between the inside surface 18*i* and the outside surface 18*s*, see FIG. 9); more preferably a value ranging from a value equal to about three-fourths (¾) of the internal diameter ID to about a value equal to the internal diameter plus about 0.67 T; and most preferably, the internal diameter a of the longitudinal bore 44 has a value essentially equal to the internal diameter ID, preferably plus or minus a minuscule amount say 0.001 inch to 0.005 inch. Stated alternatively, the longitudinal tubular insulator 40 is initially produced such that the radius (with a value of a/2 where a is the internal diameter of the tubular insulator 40) of the longitudinal bore 44 has a value ranging from a value less than the radius R of the hollow barrel 18 (e.g. a value equal to about one-half (½) of the radius R) to about a value equal to the radius R plus about 0.8 T, more preferably a value ranging from a value equal to about three-fourths (¾) of the radius R to about a value equal to the radius R plus about 0.38 T; and most preferably the radius of the longitudinal bore 44 has a value essentially equal to the radius R preferably plus or minus a minuscule amount say 0.001 inch to 0.005 inch.

The geometric features and measurements of the electrical connector 13 dictate the geometric features and measurements of the longitudinal tubular insulator 40. More specifically, the internal diameter ID or radius R of the hollow barrel 18 along with the thickness value T of the cylindrical wall of the hollow barrel 18 will determine the internal diameter a or radius of the longitudinal tubular insulator 40 which is to be flared or expanded at its opposed ends 20A and 25A into any suitable openings, not necessarily the final openings 20 and 25. Thus, for this preferred embodiment of the invention, after the longitudinal tubular insulator 40 has been provided or produced such that the internal diameter a or radius (a/2) has a value as set forth immediately above, the opposed ends 20A and 25A may be flared or expanded to any suitable opening with at least one opening preferably being funnel-shaped.

Figure 35:
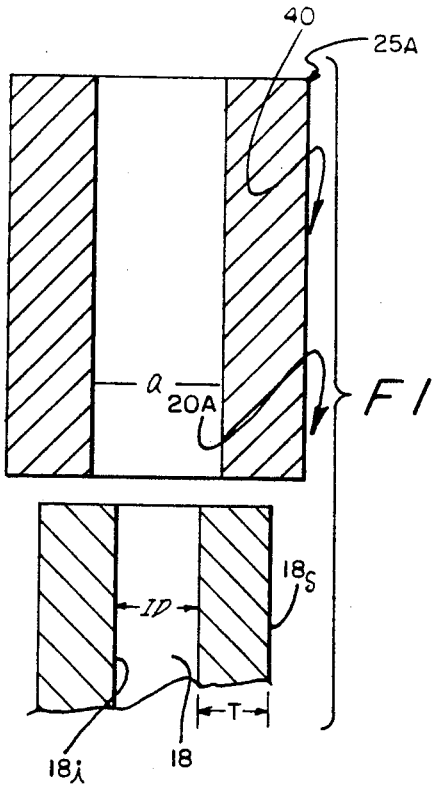
FIG. 35 is a vertical sectional view of a longitudinal tubular insulator with an internal diameter a which is larger than the internal diameter ID of a hollow barrel of an electrical connector.
Figure 36:
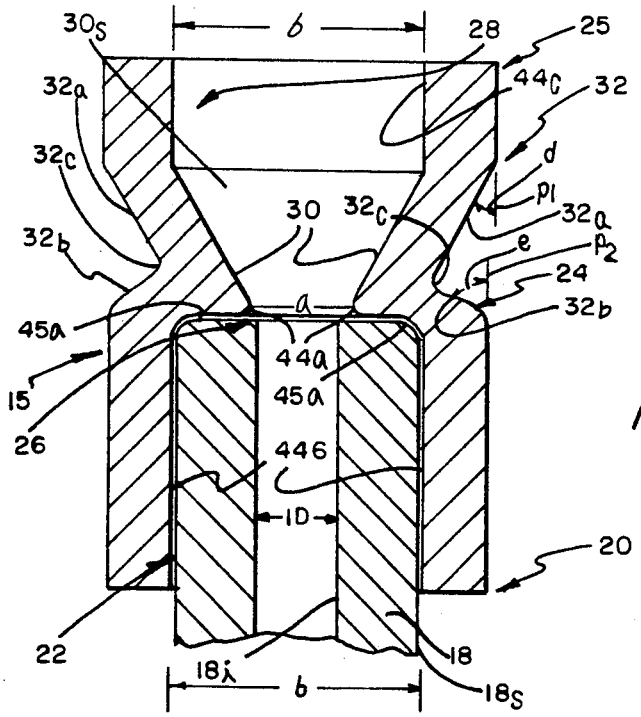
FIG. 36 is a vertical sectional view of the hollow barrel in FIG. 35 of the electrical connector slid into one of the tubular ends of the tubular insulator in FIG. 35 after the tubular insulator is flared.

By way of example only and referring to FIGS. 35 and 36, there is seen a longitudinal tubular insulator 40 having an internal diameter a, and a hollow barrel 18 of a connector 13 (whose head 14 and neck 16 are not shown). The hollow barrel 18 has a thickness value T and an internal diameter ID that is less than the internal diameter a of the longitudinal insulator 40. Stated alternatively, the internal diameter a of the longitudinal tubular insulator 40 is approximately equal to the value of the internal diameter ID plus about the value of about 1.0 T. Both ends 20A and 25A are flared or expanded respectively to any suitable openings which for purposes of illustration only will be a cylindrical opening 22 and a funnel-shaped opening defined by cylindrical opening 28 in combination with inwardly tapering walls 30*s* terminating in bore 26 having the internal diameter a as shown in FIG. 36. As further best shown in FIG. 36, after ends 20A and 25A are flared or expanded, a tubular insulator 15 is produced having the bore 22 with an internal diameter b, the bore 28 with the same internal diameter b, and inwardly tapering walls 30*s* extending from the wall 44*c* of bore 28 down to and terminating in the bore 26 having the internal diameter a which is essentially equal to the internal diameter ID plus the value of about 1.0 T. The hollow barrel 18 in FIG. 35 is slidably disposed in the bore 22.

Figure 37:
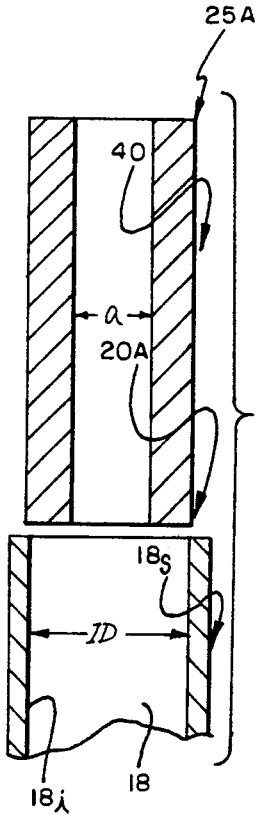
FIG. 37 is a vertical sectional view of a longitudinal tubular insulator with an internal diameter a which is less than the internal diameter ID of a hollow barrel of an electrical connector.
Figure 38:
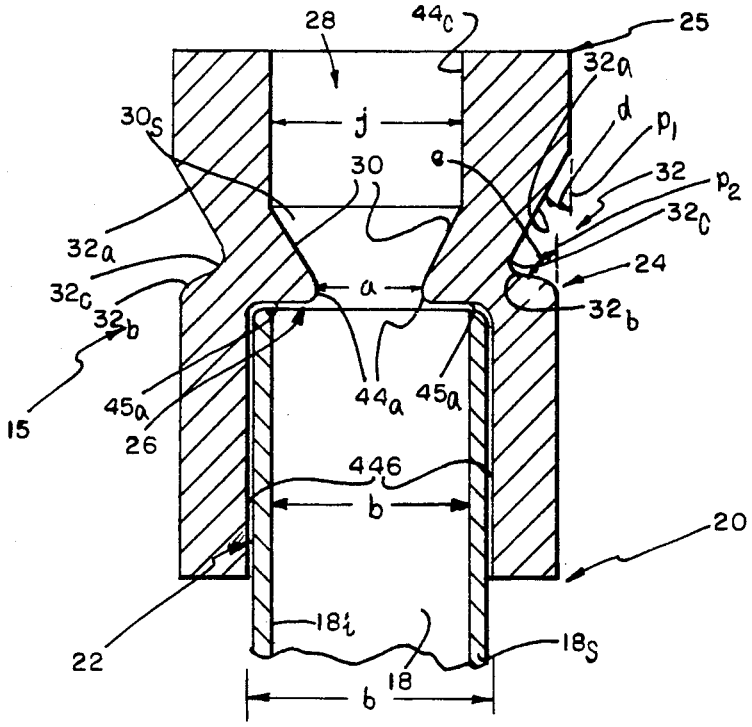
FIG. 38 is a vertical sectional view of the hollow barrel in FIG. 37 of the electrical connector slid into one of the tubular ends of the tubular insulator in FIG. 37 after the tubular insulator is flared.

By further way of example only and referring to FIGS. 37 and 38, there is seen a tubular insulator 40 having an internal diameter a and a hollow barrel 18 of a connector 13 (whose head 14 and neck 16 are not shown). The hollow barrel 18 has an internal diameter ID that is greater than the internal diameter a of the longitudinal insulator 40. Stated alternatively, the internal diameter a of the longitudinal tubular insulator 40 is approximately equal to about one-half (½) of the value of the internal diameter ID. Both ends 20A and 25A are flared or expanded respectively to any suitable opening which again for purposes of illustration only will be a cylindrical opening 28 having the internal diameter b and a funnel shaped opening defined by the cylindrical opening 28 having an internal diameter j, which is less than the internal diameter b, and the bore 30 having inwardly tapering walls 30*s* terminating in the bore 26 having the internal diameter as shown in FIG. 38. As further best shown in FIG. 38, after ends 20A and 25A are flared or expanded, a tubular insulator 15 is produced having the bore 22 with the internal diameter b, the bore 28 with the internal diameter j, and inwardly tapering walls 30*s* extending downwardly from the wall 44*c* of bore 28 to terminate in the bore 26 having the internal diameter a which is essentially equal to about one-half (½) of the value of the internal diameter ID.

As previously indicated, the internal diameter a of the bore 26 is preferably equal to about the internal diameter ID of the hollow barrel 18. To obtain this preferred embodiment, the tubular insulator 40 is to have the same internal diameter a extending preferably uniformly throughout its longitudinal structure. By starting with the longitudinal tubular insulator 40 with an internal diameter a, when both ends 20A and 25A are flared or expanded, the central structure 24 of the finally produced tubular insulator 15 has the longitudinal bore 26 with the internal diameter a. As previously mentioned ends 20A and 25A may be flared or expanded into any suitable geometric openings. Both openings may be cylindrical, or a combination of a cylindrical opening and a funnel-shaped opening which is preferred since the cylindrical opening is to receive the hollow barrel 18 and the funnel-shaped opening is to receive an insulated wire (not shown) with an exposed non-insulated wire end that is to be funneled into the hollow barrel 18.

Figure 39:
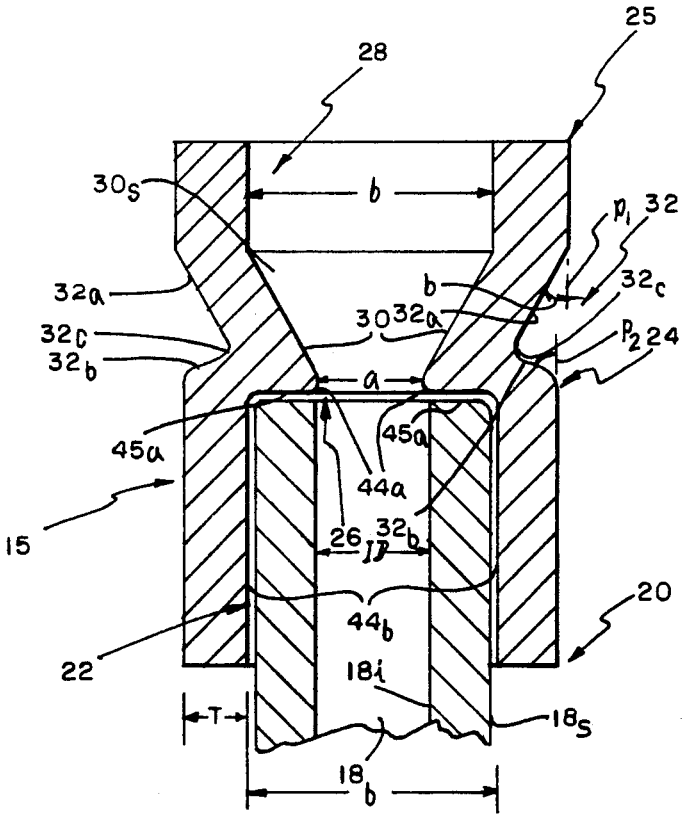
FIG. 39 is a vertical sectional view of a hollow barrel having an internal diameter ID and having been lodged into a flared end of a tubular insulator initially having an internal diameter a which is essentially equal to the internal diameter ID of the hollow barrel.

Referring now to FIG. 39, there is seen a tubular insulator 15 produced from a longitudinal tubular insulator 40 having an internal diameter essentially equal to the internal diameter ID of the hollow barrel 18 with the ends 20A and 25A of the longitudinal tubular insulator 40 having been flared or expanded respectively into the end 20 having the longitudinal bore 22 with an internal diameter b and into the end 25 having the longitudinal bore 28 having the same internal diameter b and communicating with the funnel-shaped bore 30 having inwardly tapering walls 30*s* terminating in the bore 26 with the same internal diameter a. As further shown in FIG. 39, the hollow terminal barrel 18 slidably passes into the longitudinal bore 22 such that the axis of hollow barrel 18 (more specifically the axis of the cylindrical opening defined by walls 18*i* and having the internal diameter ID) is essentially coaxial with the axis of the bore 26 having the internal diameter a. As still further shown in FIG. 39, the hollow terminal barrel 18 has a thickness value T which is essentially equal to the width of wall 45*a*. As best shown in FIGS. 9 and 39, the hollow barrel 18 of the electrical connector 13 is inserted into the longitudinal bore 22 until the leading barrel perimeter 18*b* is in proximity to wall 45*a* or circular surface 45*a* and the wall 45*a* or circular surface 45*a* extends over the leading barrel perimeter 18*p*. The produced insulated terminal 12 has the electrical connector 13 extending beyond the tubular end 20 of the tubular insulator 15. More particularly, the hollow terminal barrel 18 has a length that is generally equal to or greater than the length of the longitudinal bore 22 such that the produced insulated terminal 12 has the hollow terminal barrel 18 (and the neck 16 and the head 18) extending beyond the tubular end 20 of the tubular insulator 15.

The flaring or expanding of ends 20A and 25A of the longitudinal tubular insulator 40 may be accomplished in any suitable manner. Preferably the end 20A is flared or expanded by a bottom flare pin (or plunger), generally illustrated as 500 in FIGS. 40, 41 and 42. The bottom flare pin 500 comprises a cylindrical body 502, a cylindrical neck 504 integrally bound to the cylindrical body 502, and a conical shaped head 506. The cylindrical body 502 has a diameter that would be essentially equal to the desired diameter b of the longitudinal bore 22. The cylindrical neck 504 would have a diameter that would be essentially equal to or a little less than the diameter a of the longitudinal tubular insulator 40 so that the cylindrical neck 504 can initially enter the longitudinal bore 44 of the longitudinal tubular insulator 40. The apparatus 10, more specifically a pneumatic cylinder (which will be identified below), initially drives the bottom flare pin 500 such that the neck 504 enters the longitudinal bore 44 and continues to drive the bottom flare pin 500 such that the cylindrical body 502 causes the formation of the bore 22 in the tubular end 20A of the longitudinal tubular insulator 40 (as best shown in FIG. 34).

Figure 49:
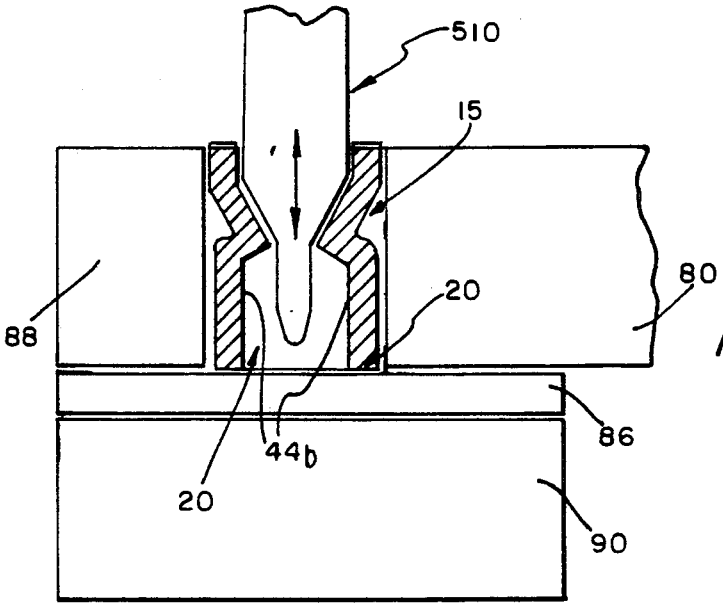
FIG. 49 is a partial vertical sectional view of the top flare pin flaring or expanding tubular end 25A of the tubular insulator in FIG. 16.

The end 25A is preferably flared or expanded by a top flare pin (or plunger), generally illustrated as 510 in FIGS. 43, 44, and 45. The top flare pin 510 comprises a cylindrical body 512; a funnel-shaped shoulder 514 integrally bound to the body 512; a cylindrical shaped neck 516 integrally bound to the shoulder 514; and a conical shaped head 518 bound to the neck 516 The cylindrical body 512 has a diameter that would be essentially equal to the desired diameter (e.g. diameter c or b or j or etc.) of the longitudinal bore 28. The shoulder 514 would be dimensioned geometrically in accordance with the desired shape of bore 30. The cylindrical neck 516 would have a diameter that would be essentially equal to or a little less than the diameter a of the bore 44 in the longitudinal tubular insulator 48 as shown in FIG. 48 so that the cylindrical neck 516 can initially enter the longitudinal bore 44. The apparatus 10, more specifically a pneumatic operated cylinder (which will be identified below), initially drives the top flare pin 510 such that the neck 516 enters the longitudinal bore 44 of the longitudinal tubular insulator 48 (see FIG. 16), and the apparatus 10 (more specifically the pneumatic operated cylinder) continues to drive the top flare pin 51*o* such that the shoulder 514 and the body 512 enters the longitudinal bore 44 to cause expansion and the formation of the bores 28 and 30 in the tubular end 25A of the tubular insulator 48 (as best shown in FIG. 49).

Figure 50:
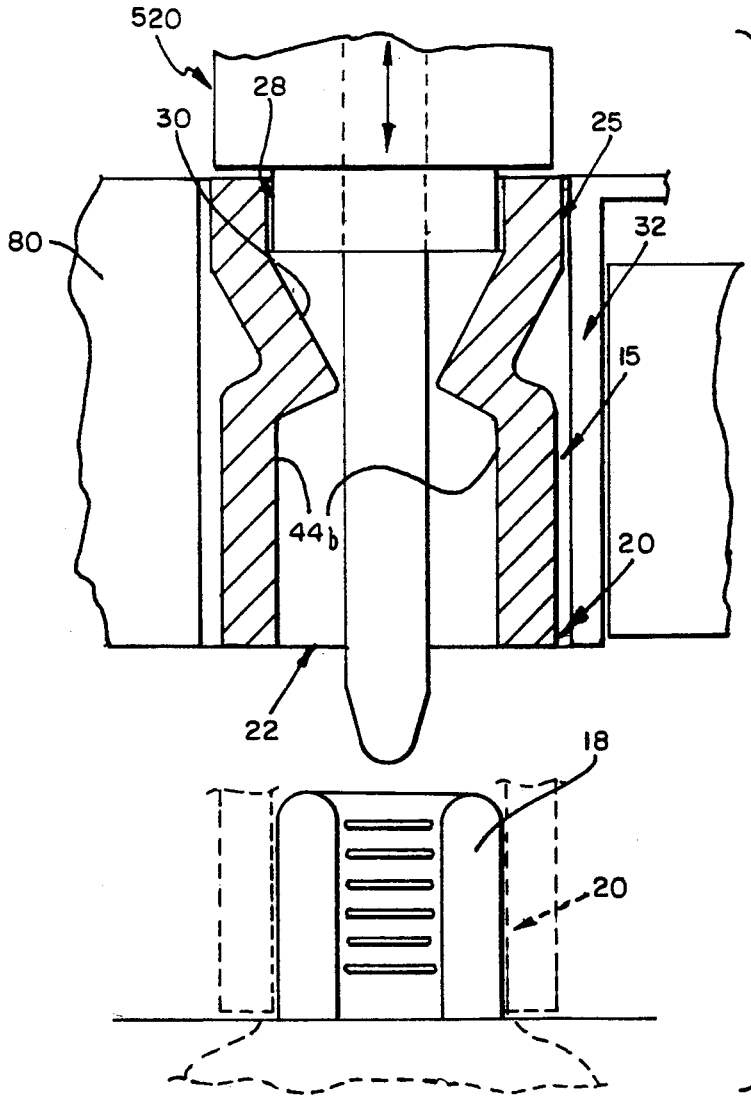
FIG. 50 is a partial vertical sectional view of the assembly pin engaged to the tubular insulator of FIG. 19 for driving the same downwardly to couple the hollow barrel of an electrical connector with the tubular insulator.

The tubular insulator 15 may be coupled or connected to the electrical connector 13 by any suitable manner. Stat®d alternatively and more specifically, the hollow terminal barrel 18 may be slid into the cylindrical bore 22 of the tubular end 20 of the tubular insulator 15 by any suitable means. Preferably, the connecting or coupling of the tubular insulator 15 to the terminal barrel 18 of the connector 13 is accomplished by an assembly pin, generally illustrated as 520 in FIGS. 46, 47 and 48. The assembly pin 520 comprises a body 522 having a cavity 524, a cylindrical shoulder 526 secured to the body 522, and a longitudinal bore 526 passing through the shoulder 526 and through the body 522 and communicating with the cavity 524. A pin member 528 slidably passes through the longitudinal bore 526 and into the cavity 524. A pin base 530 is secured to an end of the pin 528 and is slidable within and against the walls of the cavity 524. The pin member 528, more specifically the combination of the pin member 528 and the pin base 530 is biased by a spring member 532 such that when the head of the pin member 528 encounters an immovable object, the pin base 530 and pin member 528 slide towards the spring member 532. The cylindrical shoulder 526 has a diameter that is essentially equal to or slightly less than the diameter of the bore 28 in order for the latter to accommodate the cylindrical shoulder 526. The pin member 528 has a diameter valued to allow the pin member 528 to pass through the bore 26 and into the hollow barrel 18 of the connector 13. The body 522 encounters the perimetrical edge of the bore 28 on the tubular end 25 and is driven downwardly pneumatically by the apparatus 10, more specifically by a pneumatic cylinder (which will be identified below), causing the walls 44*b* of the bore 22 to pass around the outside surface 18*s* of the hollow barrel 18 as best shown in FIG. 50. When the head of the pin member 528 contacts the bottom of the hollow barrel 18, it is driven upwardly towards the spring member 532.

Referring in detail now to FIGS. 1, 3 and 20–32, there is seen the apparatus 10 for producing the insulated terminal 12. The apparatus 10 comprises a means, generally illustrated as 50, for feeding or providing a tubular insulator 40. The means 50 for feeding or providing the tubular insulator 40 communicates with a means, generally illustrated as 52, for engaging the tubular insulator 40 and moving the tubular insulator 40 into a series of positions wherein firstly tubular end 20A is flanged or expanded into internal diameter b or any other suitable diameter, and subsequently tubular end 25A is flanged or expanded into bore 28 having internal diameter c or any other suitable diameter, and funnel-shaped bore 30 communicating with bore 28. The mean 52 also functions to move the tubular insulator 15 (i.e. tubular insulator 40 after having been flared at tubular ends 20 and 25) into a position for being engaged with the connector 13, more specifically for the terminal barrel 18 of the connector slidably passing into the longitudinal bore 22.

The apparatus 10 also comprises a means, generally illustrated as 54, for expanding or flaring the tubular end 20A of the tubular insulator 40, while the tubular insulator 40 is engaged to or with the means 52. A means, generally illustrated as 56, is provided for expanding or flaring the tubular end 25A of the tubular insulator 40 (more specifically of the longitudinal tubular insulator 48). Means 56 performs the flaring of the tubular insulator 40 while engaged (more particularly while the longitudinal tubular insulator 48 is engaged) to or with the means 52 for engaging. The apparatus 10 further comprises a means, generally illustrated as 58, for feeding an electrical connector (such as connector 13) to the means 52 for engaging wherein a coupling means 60 forces or couples the tubular insulator 15 with the connector 13, more specifically slidably forces the terminal barrel 18 into the longitudinal bore 22 of the tubular insulator 15.

Figure 26:
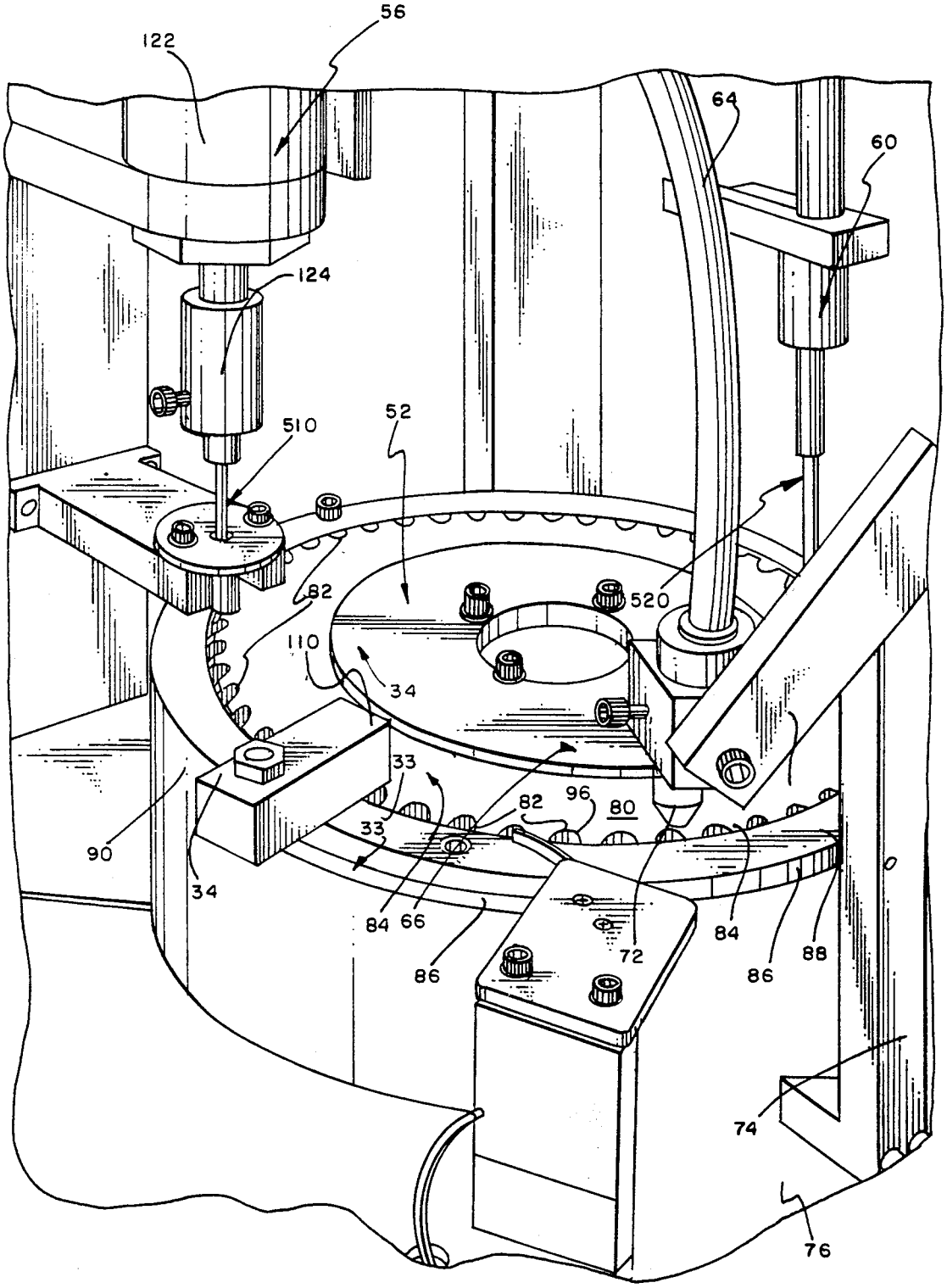
FIG. 26 is a partial perspective view of the alignment wheel and the input unit.
Figure 27:
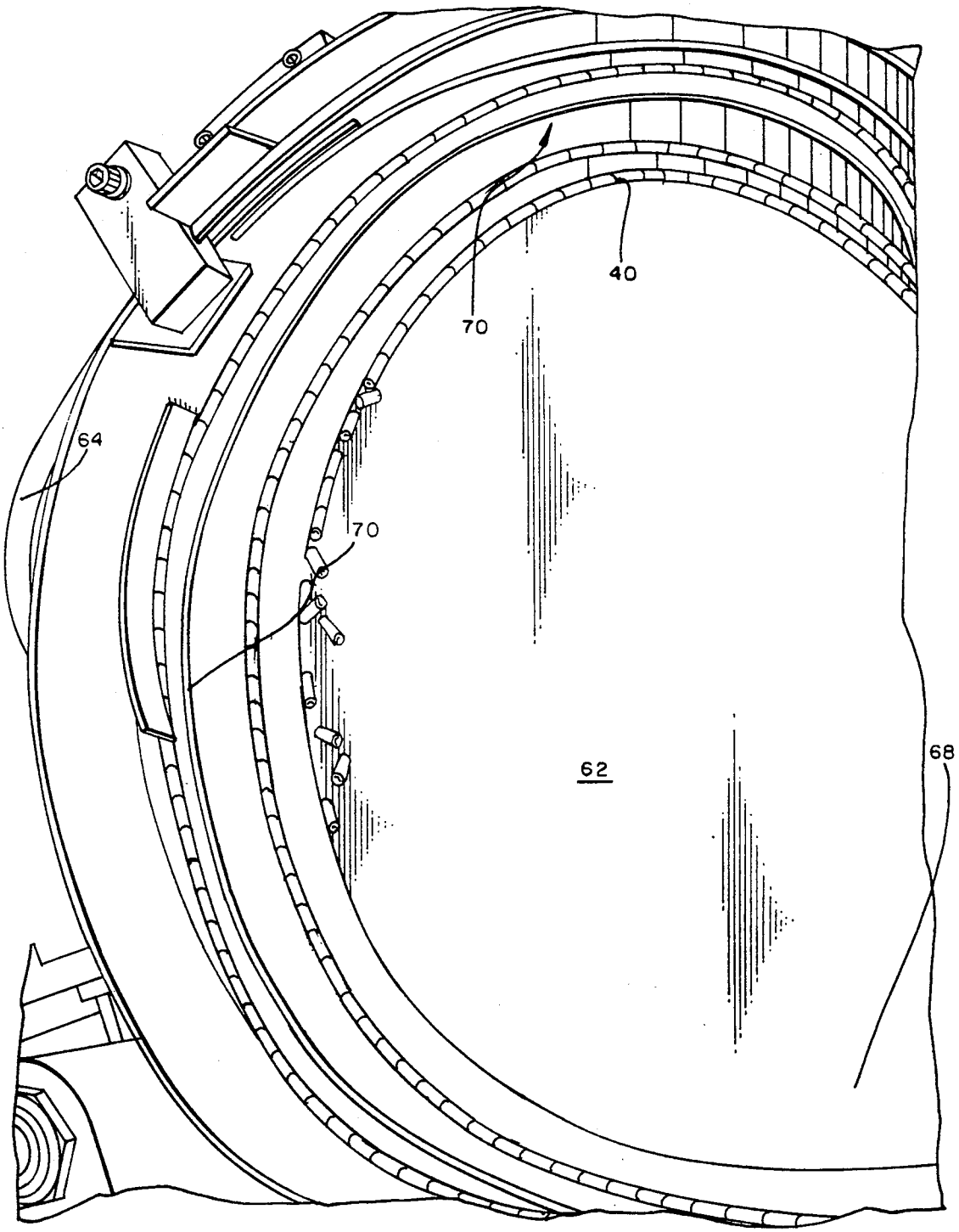
FIG. 27 is a partial top plan view of the shaker bowl.

The means 50 for feeding or providing a tubular insulator 40 comprises a shaker bowl, generally illustrated a 62, a conduit 64 engaged to and extending from the shaker bowl 62 down to an input unit 66 where the conduit 64 is coupled to the input unit 66 for serially feeding a tubular insulator 40 to the mean 52 for engaging. The shaker bowl 62 is a conventional shaker bowl 62 having a crown shaped bottom 68 and a helical shaped ridge 70 extending from the bottom 68 and traversing the inside cylindrical wall of the shaker bowl 62 and terminating in close proximity to the perimeter of the shaker bowl 62 where the ridge 70 communicates with the conduit 64 for serially feeding a tubular insulator 40 into the conduit 64. The conventional shaker bowl 62 is vibrated electromagnetically by electromagnets (not shown) causing the shaker bowl 62 to move slightly upwardly and downwardly and rotate slightly backwards and forward. The upward and slight rotational movement of the shaker bowl 62 causes the tubular insulators 40 to move onto the ridge 70 and begin an upward spiral path to the entrance of the conduit 64. After the tubular insulators 40 enter the conduit 64, they fall by gravity through the conduit 64 to a nozzle 72 of the input unit 66. As best shown in FIG. 26, in addition to the nozzle 72, the input unit 66 includes a stanchion member 74 connected to a support surface 76 of the apparatus 10, and a nozzle support arm 78 pivotally connected to the top of the stanchion member 74 and coupled to the nozzle 72.

The means 52 for engaging the tubular insulator 40 comprises an alignment wheel 80 (see FIG. 26 and 33) having a plurality of recesses 82 disposed along a perimeter 84 thereof. A structural portion (including the perimeter 84) of the alignment wheel 80 rotates along a generally circular support member 86 with a tubular insulator 40 in the recesses 82. A circular rail member 88 is superimposedly connected to the support member 86 for retaining the tubular insulator 40 in the recesses 82 as the alignment wheel 80 is turned clockwise. A riser deck 90 is mounted to the support surface 76; and the circular support member 86 is connected to the riser deck 9 and is supported by the same off of the support surface 76.

A detector means, generally illustrated as 94, is supported by the support surface 76 (see FIG. 26) and includes a spring based arm 96 for detecting a tubular insulator 40 in each recess 82. When the spring based arm 96 fails to detect a tubular insulator 40 in a recess 82, a micro-switch (not shown) trips a relay (not shown) which stops the apparatus 10. The arm 96 is serially held back by a tubular insulator 40 in each successive recess 82. When the nozzle 72 fails to deposit a tubular insulator 40 in a recess 82, the spring based arm 96 releases from contact with a tubular insulator 40 in a recess 82 immediately preceding the vacant recess 82, the arm 96 is spring-basedly moved towards the nozzle 72, causing the apparatus 10 to shut off or to stop.

Figure 29:
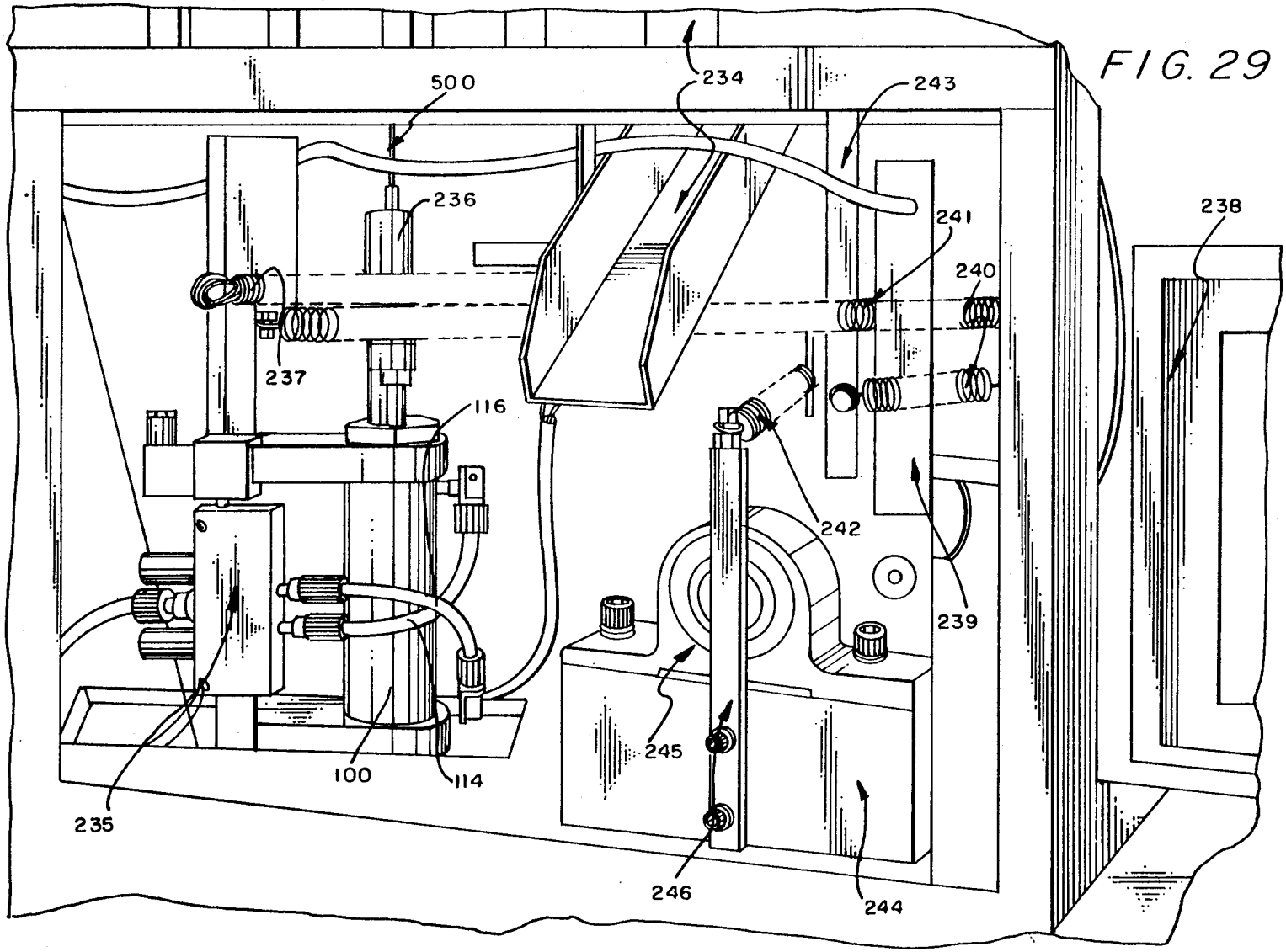
FIG. 29 is a partial perspective view of the front lower part of the apparatus of FIGS. 1 and 3.
Figure 30:
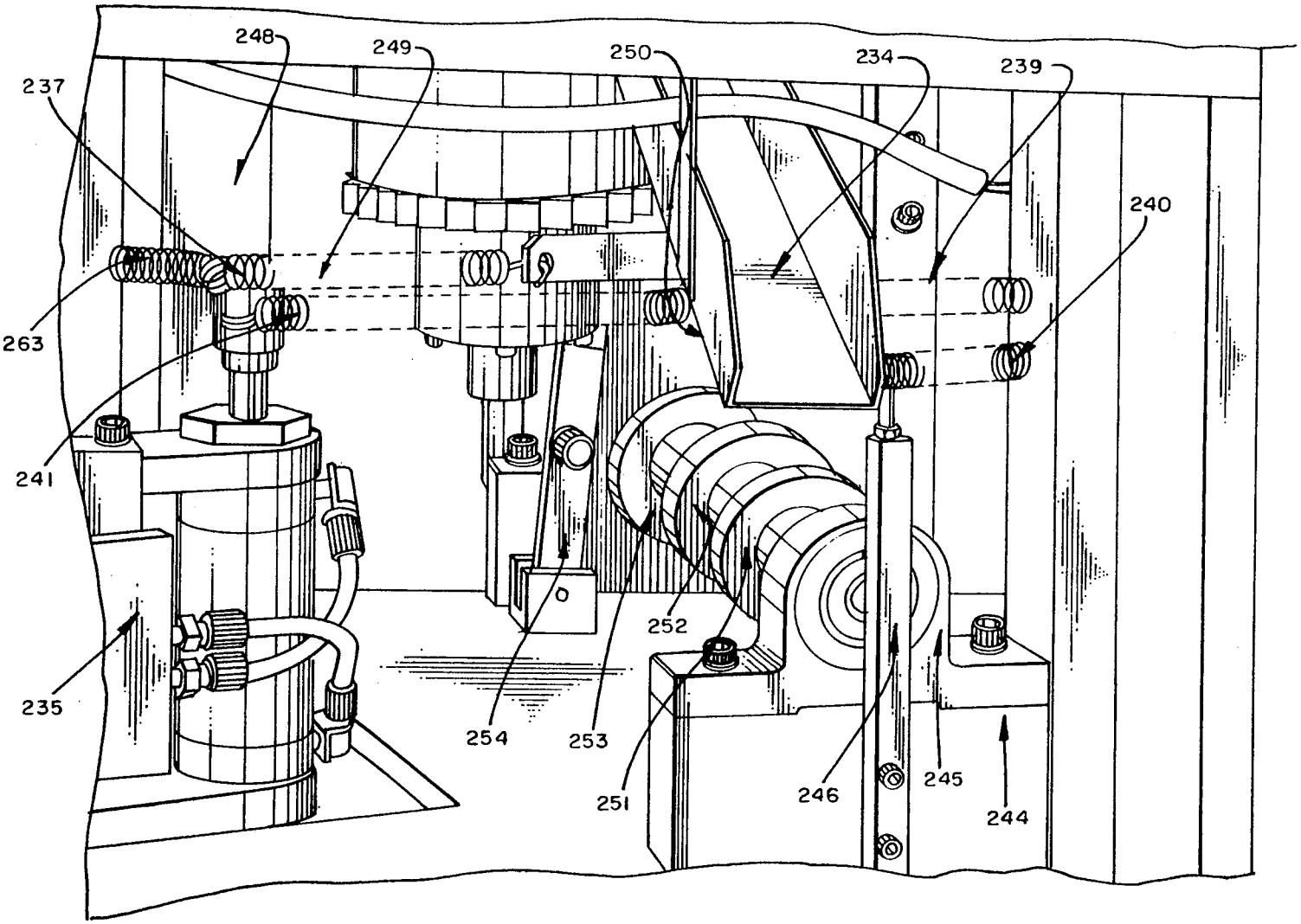
FIG. 30 is yet another partial perspective view of the rear lower part of the apparatus of FIGS. 1 and 3.
Figure 31:
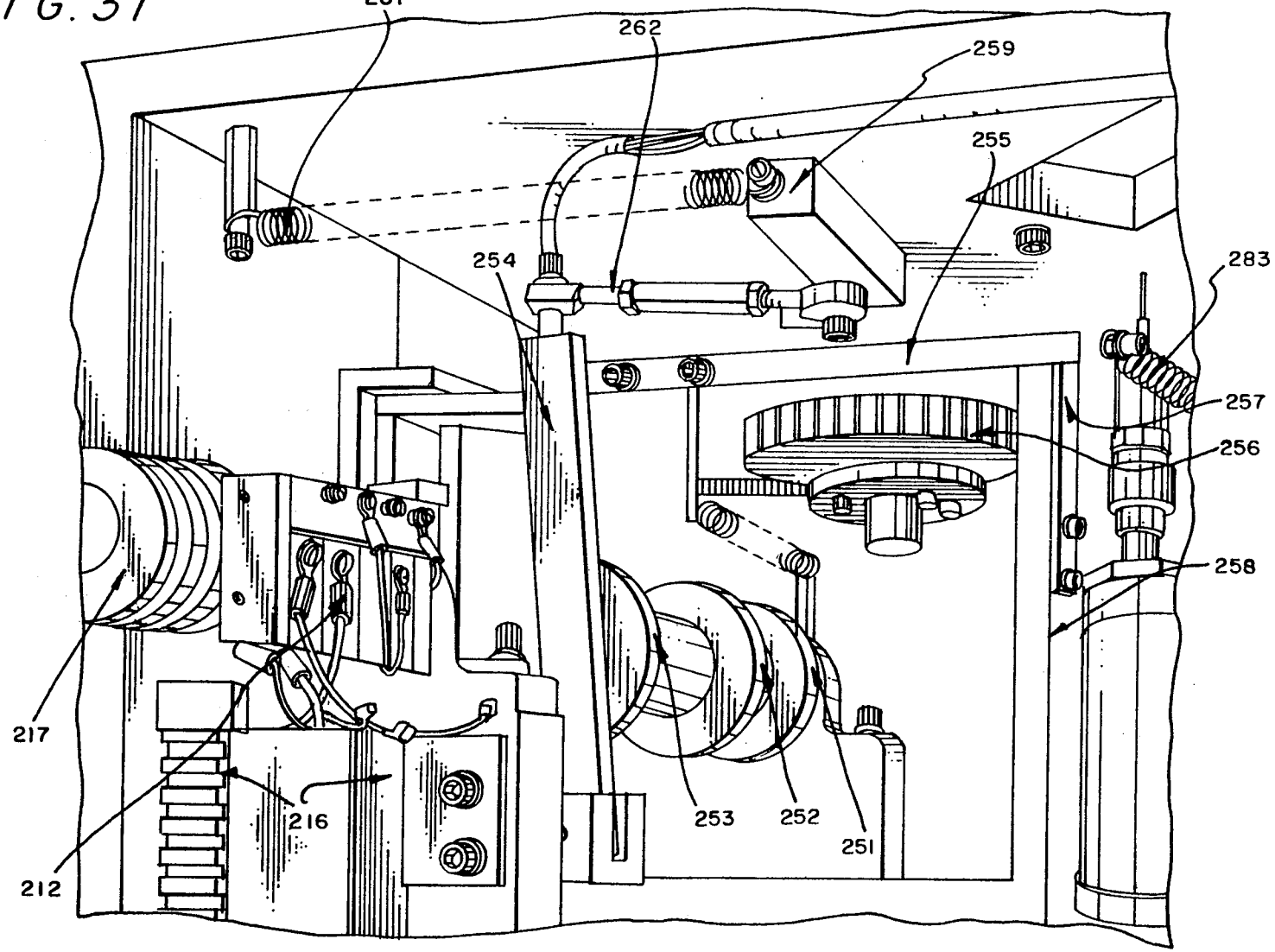
FIG. 31 is a partial perspective view of the rear lower part of the apparatus of FIGS. 1 and 3.
Figure 32:
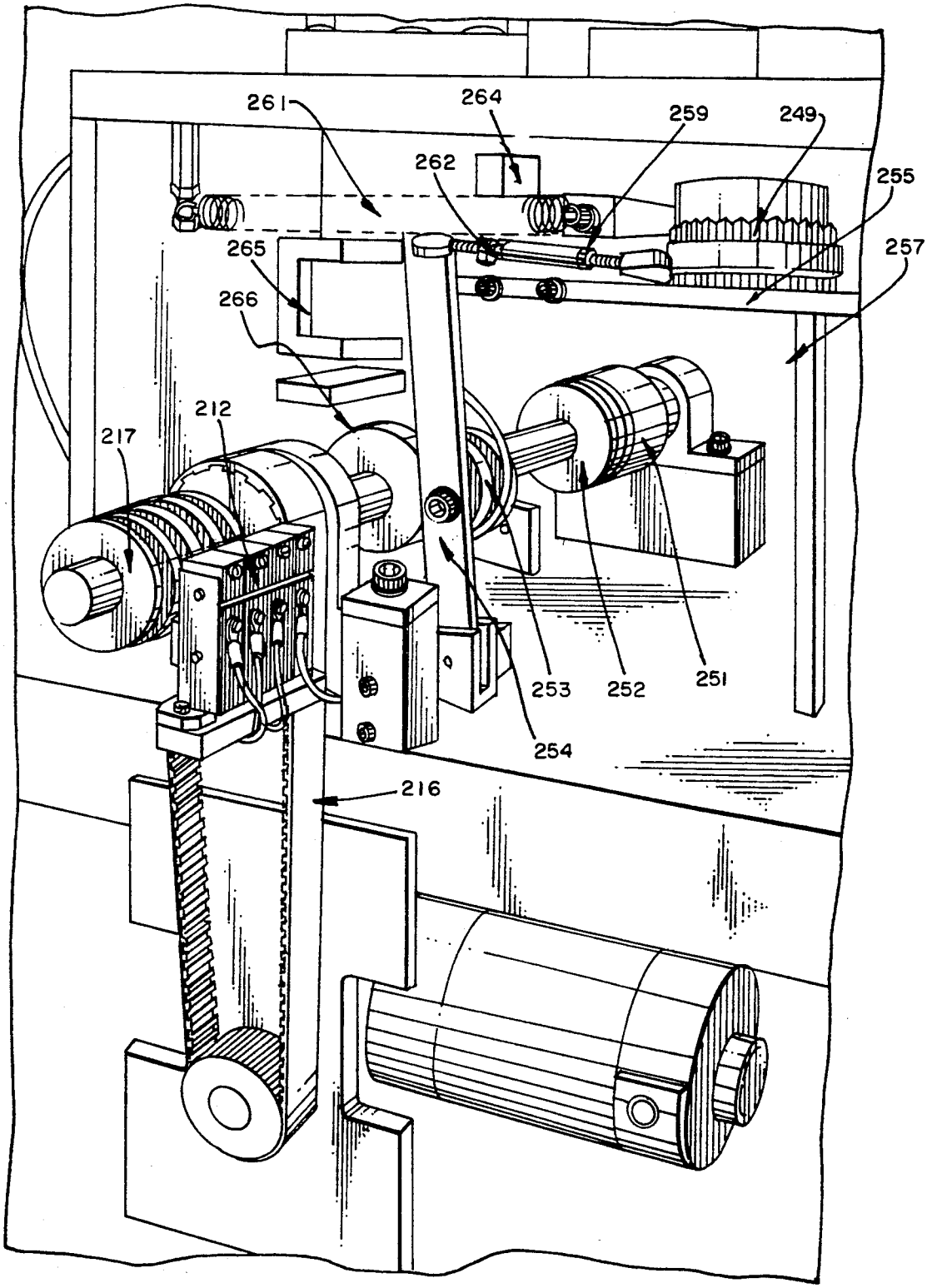
FIG. 32 is still another partial perspective view of the rear lower part of the apparatus of FIGS. 1 and 3.

The means 54 for expanding or flaring the tubular end 20A of the tubular insulator 40 comprises, as best shown in FIG. 29, a pneumatic cylinder 100 having a plunger clamp 236 for movably holding the bottom flare pin 500. The pneumatic cylinder 100 raises and lowers the pin 500 to expand or flare the tubular end 20A when the intermittently rotatable alignment wheel 80 moves a tubular insulator 40 under a stop block 110 (see FIGS. 1, 3, 26 and 34). Typically the alignment wheel 80 stops rotating long enough to allow the pneumatic cylinder 100 to perform the flaring operations. After the flaring operation, the alignment wheel 80 continues to rotate intermittently to move the flared longitudinal tubular insulator 48 towards the means 56 and to move the successive tubular insulator 40 under the stop block 110 for another flaring operation. A lower flare piston solenoid valve means 235 is provided for controlling or regulating air pressure to the pneumatic cylinder 100 via lines 112 and 114. Also best shown in FIG. 29 is an insulated electrical terminal ejection chute 234; a tension spring 237 for a ratchet gear brake; and a terminal in-line feeder mounting bracket 238. FIG. 29 further illustrates the following: a terminal transmission wobble arm 239; a tension spring 240 on terminal transmission wobble arm 239; a return spring 241 on terminal transmission wobble arm 239; a terminal clamp return spring 242; a terminal clamp arm 243; a cam shaft mounting block 244; a cam shaft bearing 245; a terminal clamp return spring mounting bracket 246; and a wiring harness 247 which extends to terminal chuck pistons 225 (see FIG. 24) and terminal in-line feeder midway inspection contact board 231 (see FIG. 24 again).

Figure 23:
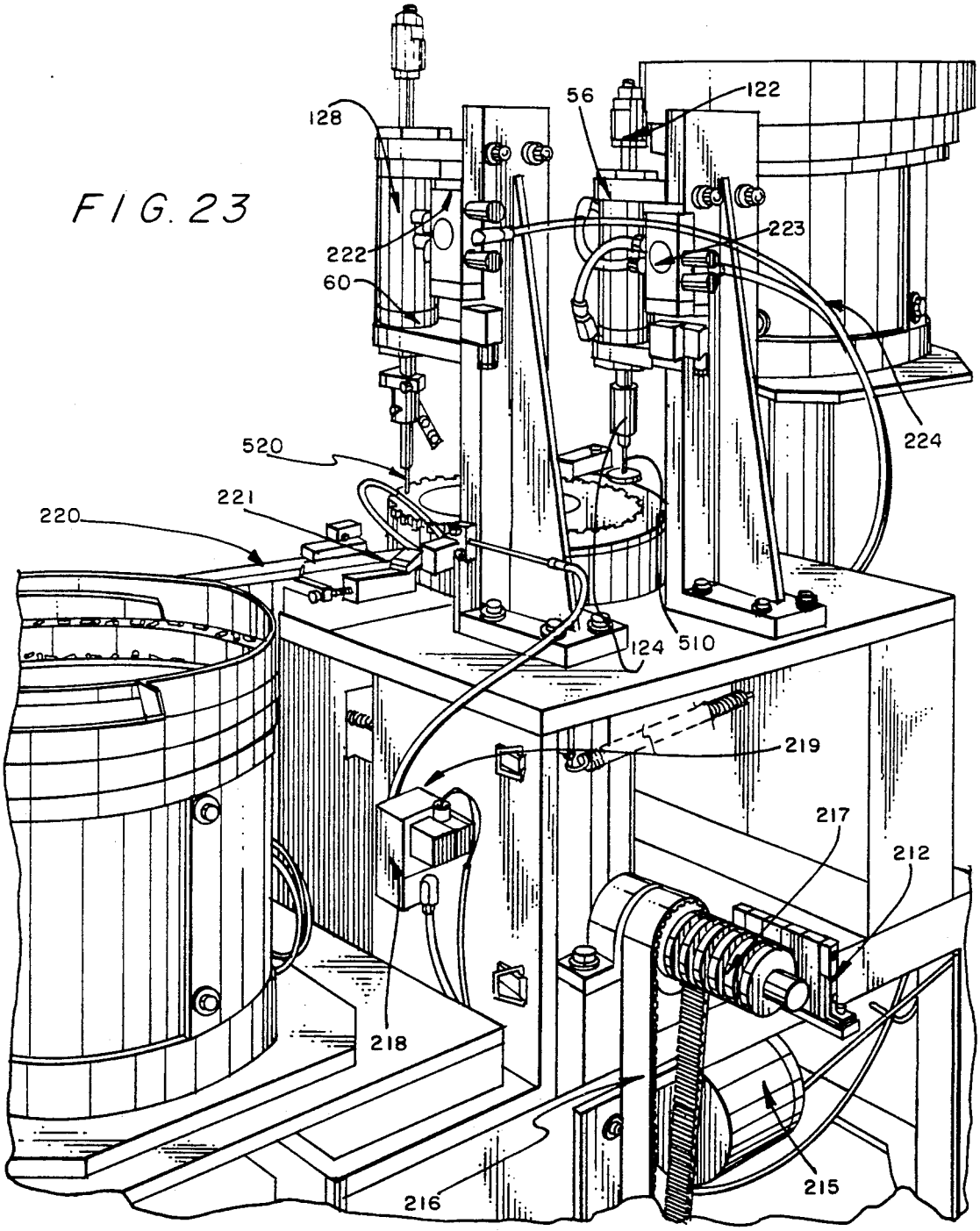
FIG. 23 is a perspective view of another side rear of the apparatus of FIGS. 1 and 3.

The means 56 for expanding or flaring tubular end 25A of the longitudinal tubular insulator 48 comprises a pneumatic cylinder 122 having a plunger clamp 124 for movably holding the top flare pin 510 (see FIG. 26). The pneumatic cylinder 122 raises and lowers the pin 510 to expand or flare the tubular end 25A when the intermittently rotable alignment wheel 80 moves a longitudinal tubular insulator 48 thereunder. The alignment wheel 80 stops rotating for a sufficient time to allow the pneumatic cylinder 122 to perform the second flaring operation. After the second flaring operation, the alignment starts rotating intermittently again to move the tubular insulator 15 towards the coupling means 60. As best shown in FIG. 23, the pneumatic cylinder 122 is coupled to a top flare piston solenoid valve 223 which has an air supply lines 224 secured thereto for supplying air pressure to the pneumatic cylinder 122. Air supply lines 224 are also secured to an assembly piston solenoid valve 222 which is coupled to the coupling means 60 (which includes a pneumatic cylinder 128) for supplying air pressure thereto. As is further shown in FIG. 23, the following is shown: A DC drive motor 215; a drive belt 216; a cam shaft 217; an air eject solenoid valve 218; a terminal chuck solenoid valve 219; a terminal in-line feeder 220 for feeding electrical connectors 13 Which are to be coupled to the tubular insulators 15.

Figure 25:
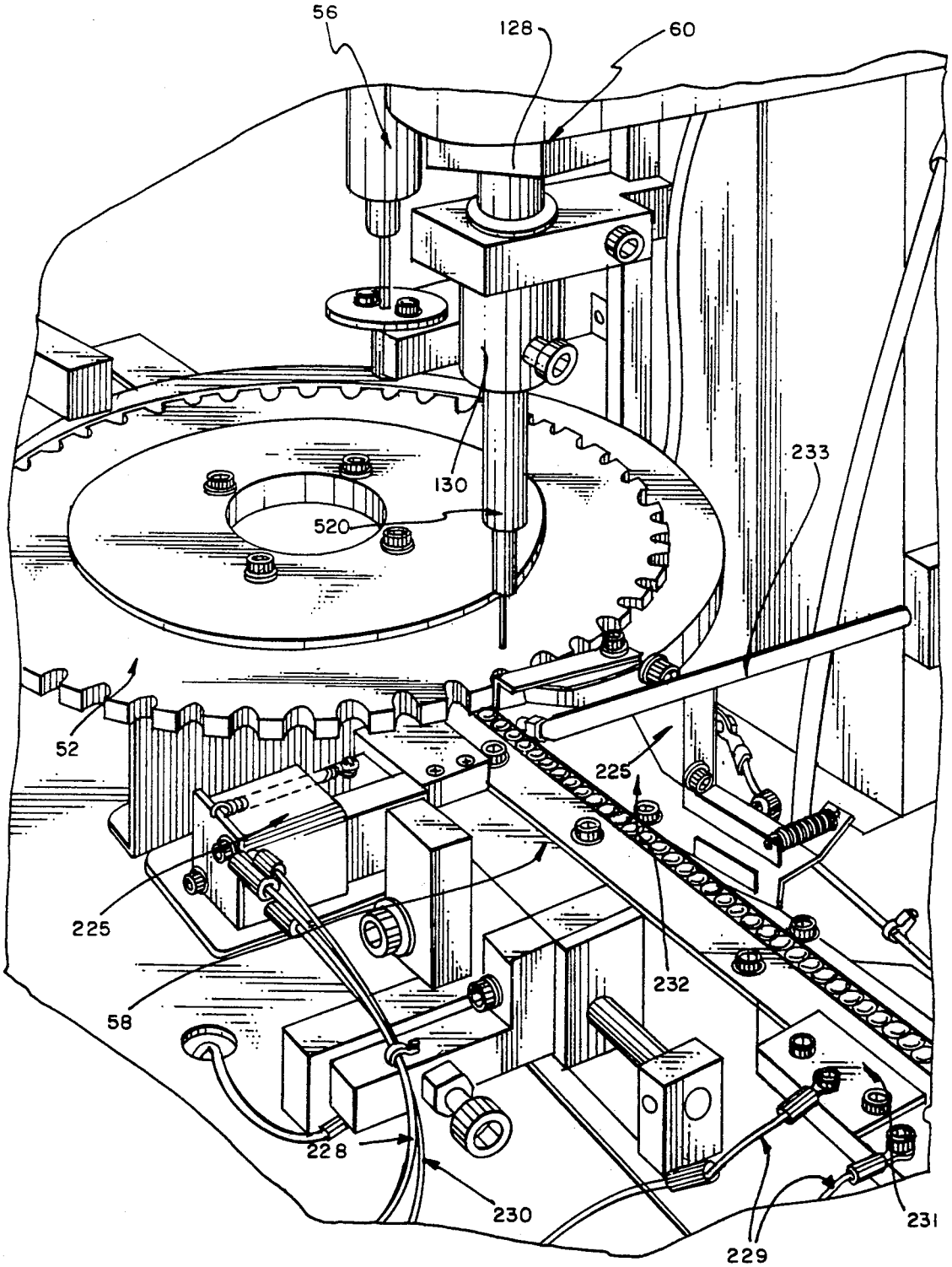
FIG. 25 is another partial perspective view of the electrical connector feed mechanism of the apparatus of FIGS. 1 and 3.

In addition to pneumatic cylinder 128 and the assembly piston solenoid valve 222, the coupling means 60 comprises a plunger clamp 130 for movably holding the assembly flare pin 520 (see FIG. 25). The pneumatic cylinder 128 raises and lowers the pin 520 to couple the tubular insulator 15 to the electrical connector 13, more specifically to drive the bore 22 over and around the terminal barrel 18 such that the outside surface **18*s* of the terminal barrel 18 is in contact with the inside cylindrical surface 44*b* (see FIG. 50). The coupling operation is performed after the alignment wheel has moved one of the tubular insulators 15 under the assembly pin 520. As previously indicated the alignment wheel 80 rotates and stops intermittently. The rotation moves not only one of the tubular insulators 15 under the assembly pair 520, but also moves one of the tubular insulators 40 over the pneumatic cylinder 100 and moves one of the longitudinal tubular insulators 48 under the pneumatic cylinder 122. After the insulators 40, 48 and 15 are disposed accordingly, all pneumatic cylinders 100, 122 and 128 activate simultaneously. After the tubular insulator 15 is coupled to the terminal barrel 18 of an electrical connector 13, the alignment wheel 80 moves and the combined insulator 15/connector 13 (i.e. an insulated electrical connector) is discharged into the discharge or ejection chute 234 while a successive insulator 15 is being moved under the assembly pin 520** for the next coupling operation.

Figure 24:
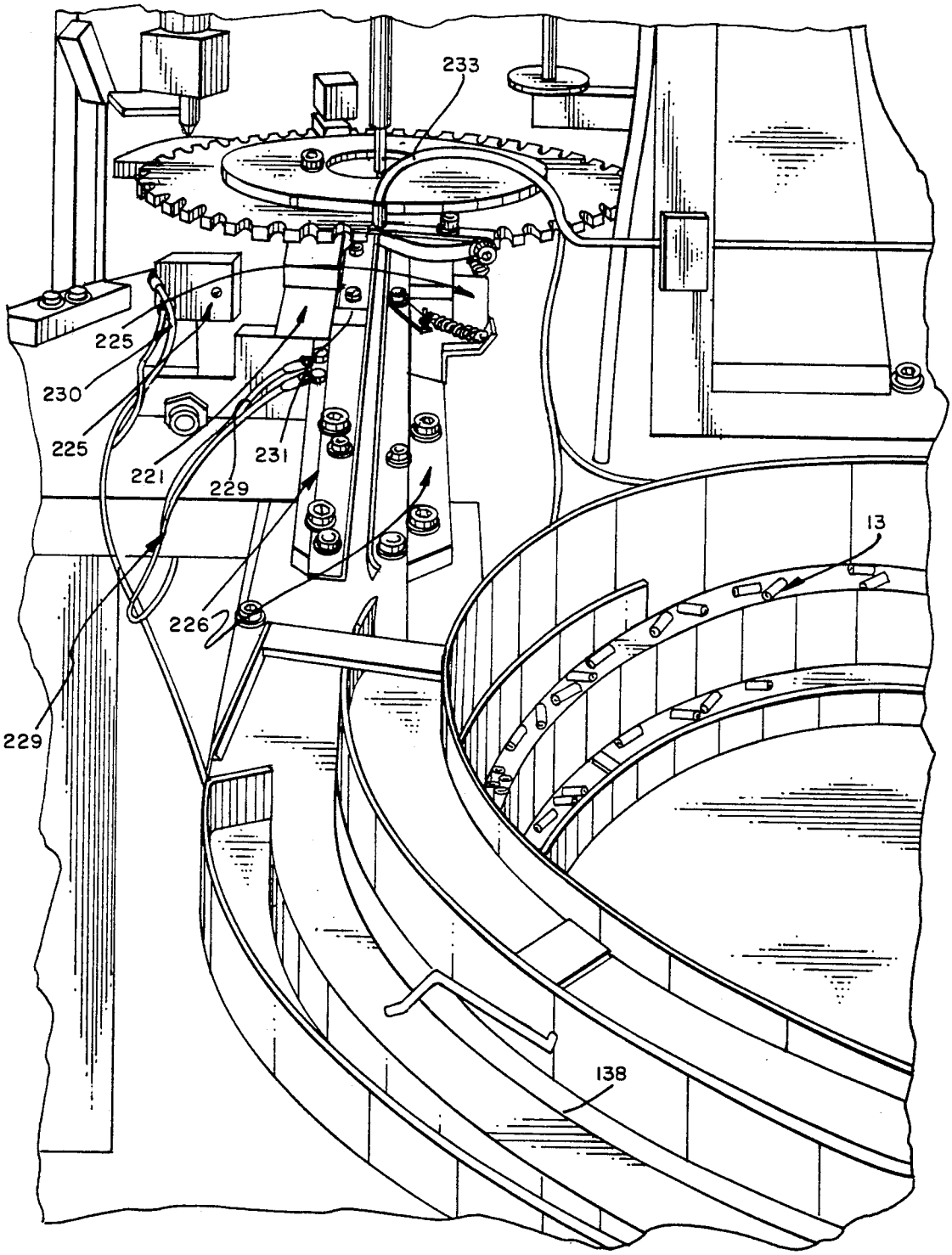
FIG. 24 is a partial perspective view of the electrical connector feed mechanism of the apparatus of FIGS. 1 and 3.
Figure 28:
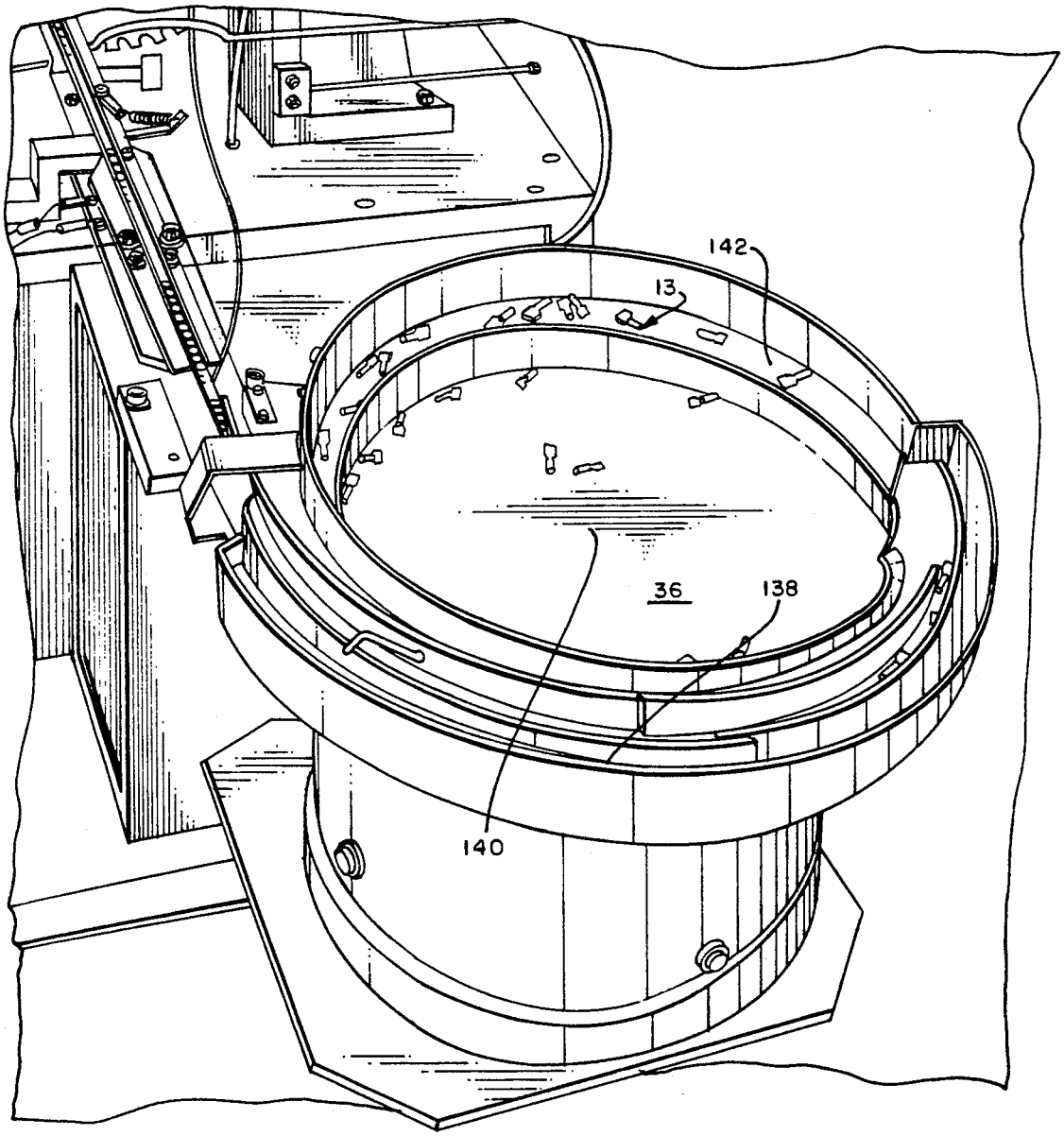
FIG. 28 is another partial perspective view of the electrical connector feed mechanism of the apparatus of FIGS. 1 and 3.

The means 58 for feeding an electrical connector 13, as best shown in FIGS. 24 and 25 and 28, comprises a shaker bowl 136 and a channel 138 extending from the shaker bowl 136 into an in-line terminal feeder support guide rails supported by terminal in-line feed supports 226-226. The shaker bowl 136 is similar to shaker bowl 62 and includes a crown shaped bottom 140 and a helical shaped ridge 142 extending from the bottom 140 and traversing spirally the inside cylindrical wall of the shaker bowl 136 and terminating in close proximity to the perimeter of the shaker bowl 136 where the ridge 142 communicates with the channel 138. The shaker bowl 136 is vibrated electromagnetically by electromagnets (not shown) causing the shaker bowl 136 to move slightly upwardly and downwardly and rotate slightly backwards and forward. The upward and slight rotational movement of the shaker bowl 136 causes the electrical connectors 13 to move onto the ridge 142 and commence an upward spiral path to the entrance of the channel 138 where the connectors 13 are deposited with the head 14 down and the terminal barrel 18 up. As further best shown in FIGS. 24, 25 and 28, the means 58 for feeding an electrical connector 13 comprises the following terminal chuck pistons 225-225; air supply line 228 for chuck pistons 225-225; wires 229 for terminal in-line feeder midway inspection contact board 231; wires 230 for terminal chuck material sensor circuit; spring tensional material holding arm 232; and air eject tube 233.

Figure 21:
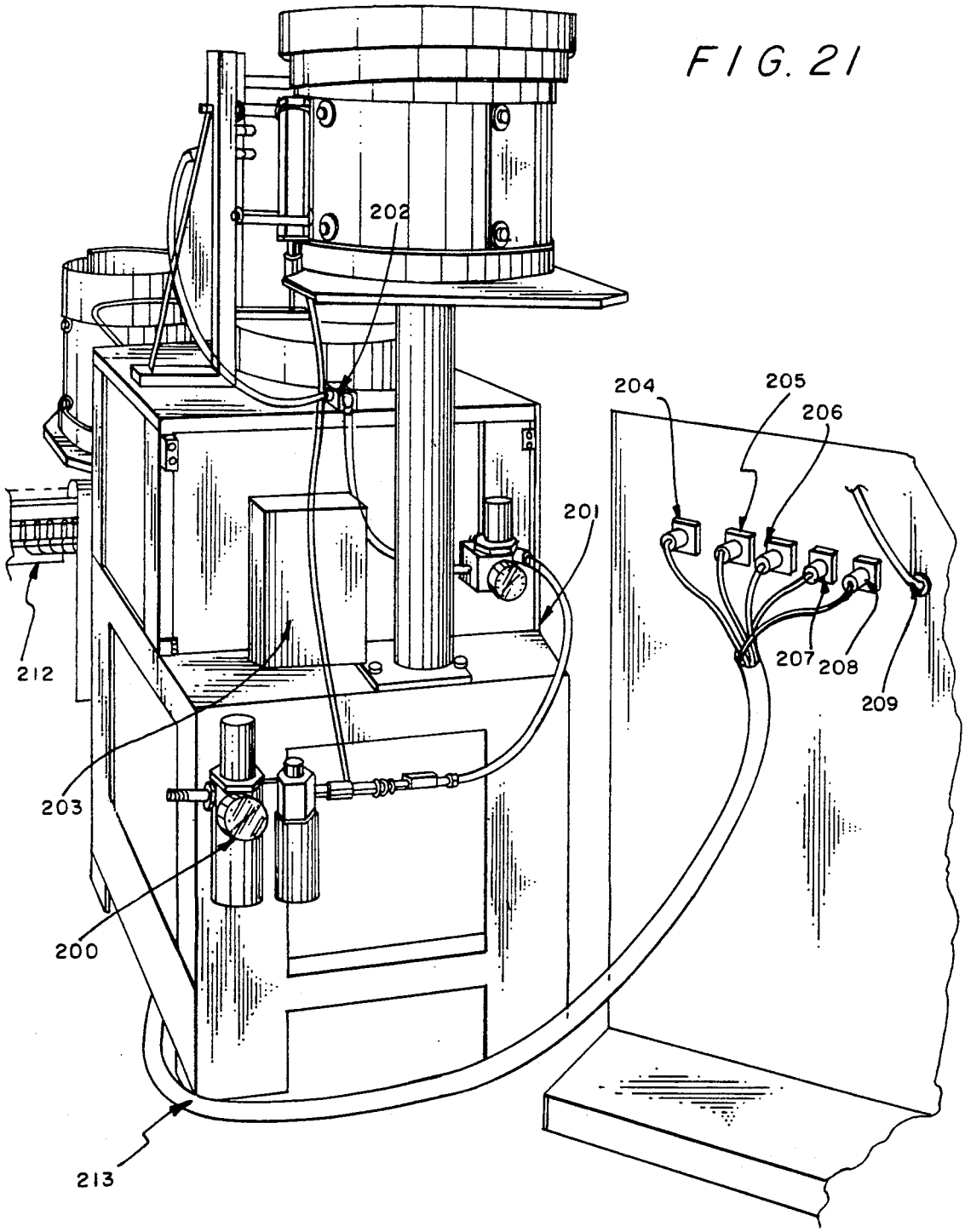
FIG. 21 is a perspective view of the side rear of the apparatus of FIGS. 1 and 3.
Figure 22:
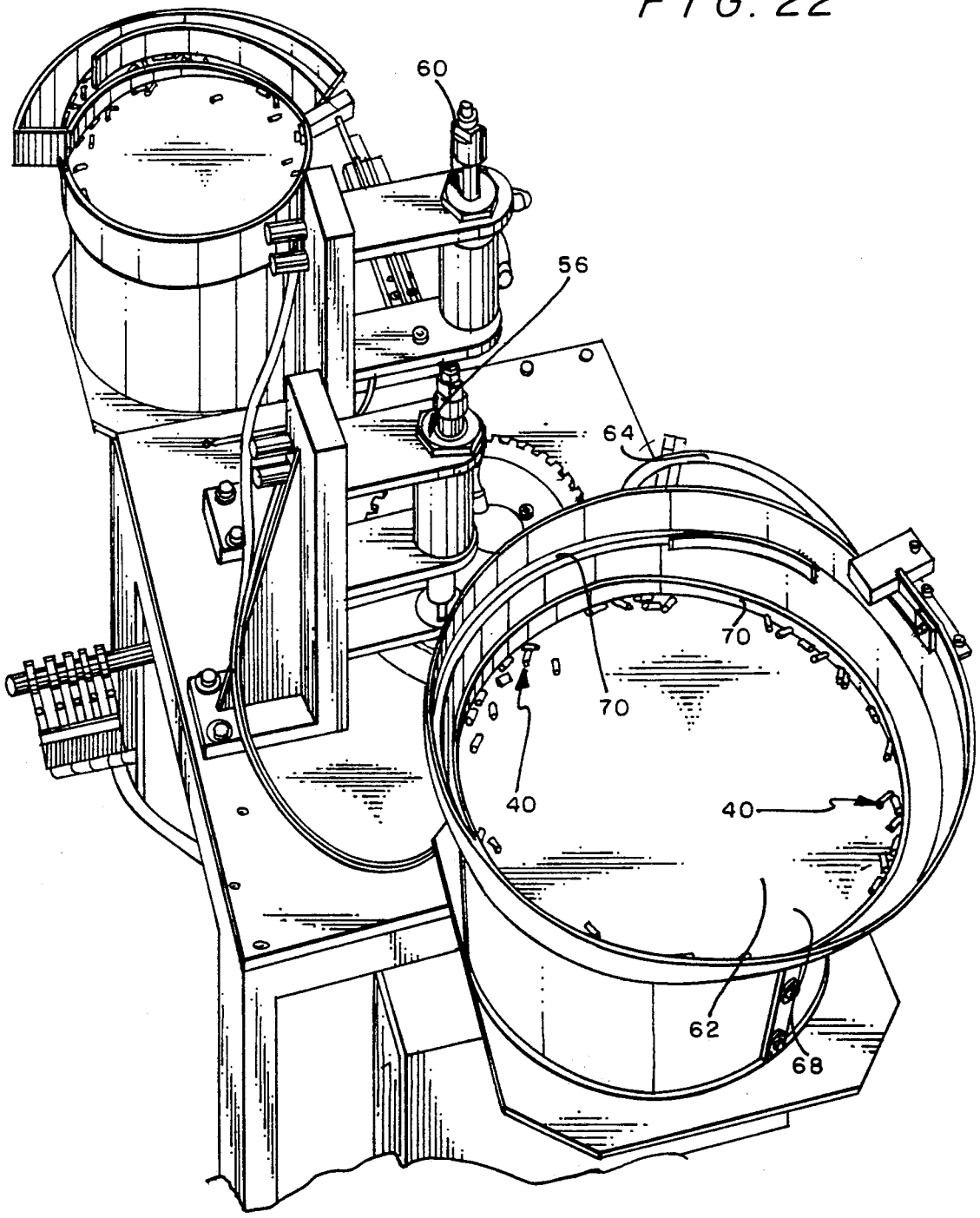
FIG. 22 is a top plan perspective view of the apparatus of FIGS. 1 and 3.

The apparatus 10 further comprises the following which are all depicted in either FIGS. 21 and/or 30 and/or 31 and/or 32; machine air systems filter regulation lubricator 200; upper piston air pressure regulator 201; air line divider manifold 202; DC motor speed control unit 203; control system sensor hook-up plug 204; insulator bowl power hook-up 205; in-line feeder power hook-up plug 206; terminal bowl power hook-up plug 207; DC motor power hook-up plug 208; system inbound power cable 209; limit switch block 212; wiring harness 213; control panel 214; mounting block 248 for tension springs 237, 241, 263; ratchet gear wheel 249; pilot release arm 250; terminal transmission cam 251; terminal clamp arm; pilot cam 253; ratchet wobble arm 254; pilot tension spring 263; pilot arm 255; pilot gear wheel 256; correct position detecting micro-switch 257 for pilot arm 255; pilot switch mounting bracket 258; ratchet push art 259; ratchet arm return spring 261; connecting rod (ratchet mechanism) 262; pilot arm return spring 263; ratchet arm stop block/contact board 264; pilot arm mounting block 265; and ratchet arm 266.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for producing an insulated electrical connector, comprising the steps of:

(a) providing a tubular insulator including a longitudinal tubular structure defining a first tubular end, a second tubular end, a central tubular structure between the first tubular end and the second tubular end, and a longitudinal bore having a generally uniform first internal diameter generally throughout the longitudinal tubular structure including through the first tubular end and through the central tubular structure and through the second tubular end;

(b) flaring the first internal diameter of the longitudinal bore in the first tubular end into a second internal diameter that is larger than the first internal diameter to produce a tubular insulator including a longitudinal tubular structure defining the first tubular end having a longitudinal bore with the second internal diameter, and the central tubular structure and the second tubular end both having the longitudinal bore with the first internal diameter;

(c) flaring the first internal diameter of the longitudinal bore in the second tubular end into a third internal diameter that is larger than the second terminal diameter of the first tubular end to produce a tubular insulator including a longitudinal tubular structure defining the first tubular end having the longitudinal bore with the second internal diameter, the central tubular structure having the longitudinal bore with the first internal diameter, and the second tubular end having a longitudinal bore with the third internal diameter;

(d) providing an electrical connector having a hollow terminal barrel with an outside diameter generally larger than the first internal diameter of the tubular insulator of step (c); and (e) inserting the hollow terminal barrel of the electrical connector into the first terminal end of the tubular insulator step (c) to produce an insulated electrical connector.

2. The method of claim 1 wherein said flaring step (b) is performed when said tubular insulator of step (a) is at a first location, and said flaring step (c) is performed when said tubular insulator produced in step (b) is at a second location.

3. The method of claim 2 wherein said first location and said second location are essentially at the same elevation.

4. The method of claim 1 wherein said tubular insulator of step (a) includes a longitudinal axis, and said method of claim 1 additionally comprises moving, prior to said flaring step (b), the tubular insulator of step (a) to a first station where the longitudinal axis of the tubular insulator is generally vertical.

5. The method of claim 4 additionally comprising moving, prior to said flaring step (c), the tubular insulator produced by step (b) to a second station where the longitudinal axis of the tubular insulator remains generally vertical.

6. The method of claim 5 wherein said moving, prior to said flaring step (c), of said tubular insulator of step (b) to said second station where the longitudinal axis of the tubular insulator remains generally vertical comprises disposing said tubular insulator of step (b) in a recess of an alignment wheel such that the longitudinal axis of the tubular insulator of step (b) remains generally vertical; and rotating the alignment wheel having said tubular insulator of step (b) disposed in said recess thereof with the longitudinal axis of the tubular insulator of step (b) remaining generally vertical.

7. The method of claim 4 wherein said moving, prior to said flaring step (b), of said tubular insulator of step (a) to said first station where the longitudinal axis of the tubular insulator is generally vertical comprises disposing said tubular insulator of step (a) in a recess of an alignment wheel such that the longitudinal axis of the tubular insulator of step (a) is generally vertical; and rotating the alignment wheel having said tubular insulator of step (a) disposed in said recess thereof with the longitudinal axis of the tubular insulator of step (a) remaining generally vertical.

8. The method of claim 1 wherein said hollow terminal barrel of the provided electrical connector of step (d) comprises an internal diameter generally equal to said first internal diameter of the tubular insulator of step (c).

9. The method of claim 8 wherein said hollow terminal barrel of the electrical connector terminates in a leading barrel perimeter; and said longitudinal bore of the first tubular end of said tubular insulator of step (c) terminates in an insulator surface that is generally normal to said longitudinal bore of said tubular end; and said inserting step (e) further comprises inserting the hollow terminal barrel of the electrical connector into the first terminal end of the tubular insulator of step (c) until the leading barrel perimeter is in proximity to the insulator surface and the insulator surface extends over the leading barrel perimeter.

10. The method of claim 9 wherein said hollow terminal barrel of the electrical connector has a terminal barrel length, and said longitudinal bore of the first tubular end of said tubular insulator of step (c) has a longitudinal bore length that is generally less than the terminal barrel length such that said inserting step (e) further comprises inserting the hollow terminal barrel of the electrical connector into the first terminal end of the tubular insulator of step (c) to produce an insulated electrical connector having the hollow terminal barrel of the electrical connector generally extending beyond the first terminal end of the tubular insulator of step (c).

11. The method of claim 9 wherein said providing step (d) further comprises providing said electrical connector having said hollow terminal barrel including a generally straight outer surface having no bell-mouth end, a neck bound to the hollow terminal barrel, and a head bound to the neck.

12. The method of claim 9 additionally comprising disposing, prior to said flaring step (b), said tubular insulator of step (a) in a recess of an alignment wheel such that the longitudinal axis of the tubular insulator of step (a) is generally vertical; rotating, prior to said flaring step (b), the alignment wheel, with the produced step (a) tubular insulator being disposed in said recess of said alignment wheel and while the longitudinal axis of the produced step (a) tubular insulator remains generally vertical, until the tubular insulator of step (a) reaches a first location where said flaring step (b) is performed while the longitudinal axis of the tubular insulator remains generally vertical; rotating, subsequent to said flaring step (b) and prior to said flaring step (c), the alignment wheel, with the produced step (b) tubular insulator remaining disposed in said recess of said alignment wheel and while the longitudinal axis of the produced step (b) tubular insulator remains generally vertical, until the tubular insulator of step (b) reaches a second location which is essentially at the same elevation as the first location and is where said flaring step (b) is performed while the longitudinal axis of the tubular insulator remains generally vertical; rotating, subsequent to said flaring step (c) and prior to said inserting step (e), the alignment wheel, with the produced step (c) tubular insulator remaining disposed in said recess of said alignment wheel and while the longitudinal axis of the produced step (c) tubular insulator remains generally vertical, until the tubular insulator of step (c) reaches a third location which is essentially at the same elevation as the second location and is where said inserting step (e) is performed while the longitudinal axis of the tubular insulator remains generally vertical.

13. The method of claim 9 additionally comprising providing, prior to said flaring step (c), a flare pin comprising a cylindrical pin body having a diameter that would be essentially equal to the third internal diameter of the longitudinal bore in the second tubular end of produced tubular insulator of step (c), and a funnel-shaped pin shoulder integrally bound to the cylindrical pin body, and a cylindrical shaped pin neck integrally bound to the funnel-shaped pin shoulder and having a diameter that would be essentially a little less than the first internal diameter of the longitudinal bore through the central tubular structure and the second tubular end of the produced tubular insulator of step (b), and a conical shaped pin head bound to the cylindrical shaped pin neck; and said flaring step (c) comprises passing the cylindrical shaped pin neck and the conical shaped pin head into and through the longitudinal bore of the central tubular structure and the second tubular end of the produced tubular insulator of step (b) and passing the funnel-shaped pin shoulder and the cylindrical pin body into the longitudinal bore of the second tubular end of the produced tubular insulator of step (b) until the conical shaped pin head extends into the longitudinal bore of the first tubular end of the produced tubular insulator of step (b).

14. The method of claim 8 wherein said providing step (d) further comprises providing said electrical connector having said hollow terminal barrel including a generally straight outer surface having no bell-mouth end, a neck bound to the hollow terminal barrel, and a head bound to the neck.

15. The method of claim 8 additionally comprising disposing, prior to said flaring step (b), said tubular insulator of step (a) in a recess of an alignment wheel such that the longitudinal axis of the tubular insulator of step (a) is generally vertical; rotating, prior to said flaring step (b), the alignment wheel, with the produced step (a) tubular insulator being disposed in said recess of said alignment wheel and while the longitudinal axis of the produced step (a) tubular insulator remains generally vertical, until the tubular insulator of step (a) reaches a first location where said flaring step (b) is performed while the longitudinal axis of the tubular insulator remains generally vertical; rotating, subsequent to said flaring step (b) and prior to said flaring step (c), the alignment wheel, with the produced step (b) tubular insulator remaining disposed in said recess of said alignment wheel and while the longitudinal axis of the produced step (b) tubular insulator remains generally vertical, until the tubular insulator of step (b) reaches a second location which is essentially at the same elevation as the first location and is where said flaring step (b) is performed while the longitudinal axis of the tubular insulator remains generally vertical; rotating, subsequent to said flaring step (c) and prior to said inserting step (e), the alignment wheel, with the produced step (c) tubular insulator remaining disposed in said recess of said alignment wheel and while the longitudinal axis of the produced step (c) tubular insulator remains generally vertical, until the tubular insulator of step (c) reaches a third location which is essentially at the same elevation as the second location and is where said inserting step (e) is performed while the longitudinal axis of the tubular insulator remains generally vertical.

16. The method of claim 8 additionally comprising providing, prior to said flaring step (c), a flare pin comprising a cylindrical pin body having a diameter that would be essentially equal to the third internal diameter of the longitudinal bore in the second tubular end of produced tubular insulator of step (c), and a funnel-shaped pin shoulder integrally bound to the cylindrical pin body, and a cylindrical shaped pin neck integrally bound to the funnel-shaped pin shoulder and having a diameter that would be essentially a little less than the first internal diameter of the longitudinal bore through the central tubular structure and the second tubular end of the produced tubular insulator of step (b), and a conical shaped pin head bound to the cylindrical shaped pin neck; and said flaring step (c) comprises passing the cylindrical shaped pin neck and the conical shaped pin head into and through the longitudinal bore of the central tubular structure and the second tubular end of the produced tubular insulator of step (b) and passing the funnel-shaped pin shoulder and the cylindrical pin body into the longitudinal bore of the second tubular end of the produced tubular insulator of step (b) until the conical shaped pin head extends into the longitudinal bore of the first tubular end of the produced tubular insulator of step (b).

17. The method of claim 1 wherein said hollow terminal barrel of the electrical connector terminals in a leading barrel perimeter; and said longitudinal bore of the first tubular end of said tubular insulator of step (c) terminates in an insulator surface that is generally normal to said longitudinal bore of said tubular end; and said inserting step (e) further comprises inserting the hollow terminal barrel of the electrical connector into the first terminal end of the tubular insulator of step (c) until the leading barrel perimeter is in proximity to the insulator surface and the insulator surface extends over the leading barrel perimeter.

18. The method of claim 17 wherein said inserting step (e) further comprises inserting the hollow terminal barrel of the electrical connector into the first terminal end of the tubular insulator of step (c) to produce an insulated electrical connector having the electrical connector generally extending beyond the first terminal end of the tubular insulator of step (c).

19. The method of claim 17 wherein said providing step (d) further comprises providing said electrical connector having said hollow terminal barrel including a generally straight outer surface having no bell-mouth end, a neck bound to the hollow terminal barrel, and a head bound to the neck.

20. The method of claim 17 additionally comprising disposing, prior to said flaring step (b), said tubular insulator of step (a) in a recess of an alignment wheel such that the longitudinal axis of the tubular insulator of step (a) is generally vertical; rotating, prior to said flaring step (b), the alignment wheel, with the produced step (a) tubular insulator being disposed in said recess of said alignment wheel and while the longitudinal axis of the produced step (a) tubular insulator remains generally vertical, until the tubular insulator of step (a) reaches a first location where said flaring step (b) is performed while the longitudinal axis of the tubular insulator remains generally vertical; rotating, subsequent to said flaring step (b) and prior to said flaring step (c), the alignment wheel, with the produced step (b) tubular insulator remaining disposed in said recess of said alignment wheel and while the longitudinal axis of the produced step (b) tubular insulator remains generally vertical, until the tubular insulator of step (b) reaches a second location which is essentially at the same elevation as the first location and is where said flaring step (b) is performed while the longitudinal axis of the tubular insulator remains generally vertical; rotating, subsequent to said flaring step (c) and prior to said inserting step (e), the alignment wheel, with the produced step (c) tubular insulator remaining disposed in said recess of said alignment wheel and while the longitudinal axis of the produced step (c) tubular insulator remains generally vertical, until the tubular insulator of step (c) reaches a third location which is essentially at the same elevation as the second location and is where said inserting step (e) is performed while the longitudinal axis of the tubular insulator remains generally vertical.

21. The method of claim 20 additionally comprising providing, prior to said flaring step (c), a flare pin comprising a cylindrical pin body having a diameter that would be essentially equal to the third internal diameter of the longitudinal bore in the second tubular end of produced tubular insulator of step (c), and a funnel-shaped pin shoulder integrally bound to the cylindrical pin body, and a cylindrical shaped pin neck integrally bound to the funnel-shaped pin shoulder and having a diameter that would be essentially a little less than the first internal diameter of the longitudinal bore through the central tubular structure and the second tubular end of the produced tubular insulator of step (b), and a conical shaped pin head bound to the cylindrical shaped pin neck; and said flaring step (c) comprises passing the cylindrical shaped pin neck and the conical shaped pin head into and through the longitudinal bore of the central tubular structure and the second tubular end of the produced tubular insulator of step (b) and passing the funnel-shaped pin shoulder and the cylindrical pin body into the longitudinal bore of the second tubular end of the produced tubular insulator of step (b) until the conical shaped pin head extends into the longitudinal bore of the first tubular end of the produced tubular insulator of step (b).

22. The method of claim 17 additionally comprising providing, prior to said flaring step (c), a flare pin comprising a cylindrical pin body having a diameter that would be essentially equal to the third internal diameter of the longitudinal bore in the second tubular end of produced tubular insulator of step (c), and a funnel-shaped pin shoulder integrally bound to the cylindrical pin body, and a cylindrical shaped pin neck integrally bound to the funnel-shaped pin shoulder and having a diameter that would be essentially a little less than the first internal diameter of the longitudinal bore through the central tubular structure and the second tubular end of the produced tubular insulator of step (b), and a conical shaped pin head bound to the cylindrical shaped pin neck; and said flaring step (c) comprises passing the cylindrical shaped pin neck and the conical shaped pin head into and through the longitudinal bore of the central tubular structure and the second tubular end of the produced tubular insulator of step (b) and passing the funnel-shaped pin shoulder and the cylindrical pin body into the longitudinal bore of the second tubular end of the produced tubular insulator of step (b) until the conical shaped pin head extends into the longitudinal bore of the first tubular end of the produced tubular insulator of step (b).

23. The method of claim 1 wherein said inserting step (e) further comprises inserting the hollow terminal barrel of the electrical connector into the first terminal end of the tubular insulator of step (c), to produce an insulated electrical connector having the hollow terminal barrel of the electrical connector generally extending beyond the first terminal end of the tubular insulator of step (c).

24. The method of claim 23 wherein said providing step (d) further comprises providing said electrical connector having said hollow terminal barrel including a generally straight outer surface having no bell-mouth end, a neck bound to the hollow terminal barrel, and a head bound to the neck, such that said head extends beyond the first terminal end of the tubular insulator of step (c).

25. The method of claim 23 additionally comprising disposing, prior to said flaring step (b), said tubular insulator of step (a) in a recess of an alignment wheel such that the longitudinal axis of the tubular insulator of step (a) is generally vertical; rotating, prior to said flaring step (b), the alignment wheel, with the produced step (a) tubular insulator being disposed in said recess of said alignment wheel and while the longitudinal axis of the produced step (a) tubular insulator remains generally vertical, until the tubular insulator of step (a) reaches a first location where said flaring step (b) is performed while the longitudinal axis of the tubular insulator remains generally vertical; rotating, subsequent to said flaring step (b) and prior to said flaring step (c), the alignment wheel, with the produced step (b) tubular insulator remaining disposed in said recess of said alignment wheel and while the longitudinal axis of the produced step (b) tubular insulator remains generally vertical, until the tubular insulator of step (b) reaches a second location which is essentially at the same elevation as the first location and is where said flaring step (b) is performed while the longitudinal axis of the tubular insulator remains generally vertical; rotating, subsequent to said flaring step (c) and prior to said inserting step (e), the alignment wheel, with the produced step (c) tubular insulator remaining disposed in said recess of said alignment wheel and while the longitudinal axis of the produced step (c) tubular insulator remains generally vertical, until the tubular insulator of step (c) reaches a third location which is essentially at the same elevation as the second location and is where said inserting step (e) is performed while the longitudinal axis of the tubular insulator remains generally vertical.

26. The method of claim 23 additionally comprising providing, prior to said flaring step (c), a flare pin comprising a cylindrical pin body having a diameter that would be essentially equal to the third internal diameter of the longitudinal bore in the second tubular end of produced tubular insulator of step (c), and a funnel-shaped pin shoulder integrally bound to the cylindrical pin body, and a cylindrical shaped pin neck integrally bound to the funnel-shaped pin shoulder and having a diameter that would be essentially a little less than the first internal diameter of the longitudinal bore through the central tubular structure and the second tubular end of the produced tubular insulator of step (b), and a conical shaped pin head bound to the cylindrical shaped pin neck; and said flaring step (c) comprises passing the cylindrical shaped pin neck and the conical shaped pin head into and through the longitudinal bore of the central tubular structure and the second tubular end of the produced tubular insulator of step (b) and passing the funnel-shaped pin shoulder and the cylindrical pin body into the longitudinal bore of the second tubular end of the produced tubular insulator of step (b) until the conical shaped pin head extends into the longitudinal bore of the first tubular end of the produced tubular insulator of step (b).

27. The method of claim 1 wherein said providing step (d) further comprises providing said electrical connector having said hollow terminal barrel including a generally straight outer surface having no bell-mouth end, a neck bound to the hollow terminal barrel, and a head bound to the neck.

28. The method of claim 23 additionally comprising disposing, prior to said flaring step (b), said tubular insulator of step (a) in a recess of an alignment wheel such that the longitudinal axis of the tubular insulator of step (a) is generally vertical; rotating, prior to said flaring step (b), the alignment wheel, with the produced step (a) tubular insulator being disposed in said recess of said alignment wheel and while the longitudinal axis of the produced step (a) tubular insulator remains generally vertical, until the tubular insulator of step (a) reaches a first location where said flaring step (b) is performed while the longitudinal axis of the tubular insulator remains generally vertical; rotating, subsequent to said flaring step (b) and prior to said flaring step (c), the alignment wheel, with the produced step (b) tubular insulator remaining disposed in said recess of said alignment wheel and while the longitudinal axis of the produced step (b) tubular insulator remains generally vertical, until the tubular insulator of step (b) reaches a second location which is essentially at the same elevation as the first location and is where said flaring step (b) is performed while the longitudinal axis of the tubular insulator remains generally vertical; rotating, subsequent to said flaring step (c) and prior to said inserting step (e), the alignment wheel, with the produced step (c) tubular insulator remaining disposed in said recess of said alignment wheel and while the longitudinal axis of the produced step (c) tubular insulator remains generally vertical, until the tubular insulator of step (c) reaches a third location which is essentially at the same elevation as the second location and is where said inserting step (e) is performed while the longitudinal axis of the tubular insulator remains generally vertical.

29. The method of claim 1 additionally comprising providing, prior to said flaring step (c), a flare pin comprising a cylindrical pin body having a diameter that would be essentially equal to the third internal diameter of the longitudinal bore in the second tubular end of produced tubular insulator of step (c), and a funnel-shaped pin shoulder integrally bound to the cylindrical pin body, and a cylindrical shaped pin neck integrally bound to the funnel-shaped pin shoulder and having a diameter that would be essentially a little less than the first internal diameter of the longitudinal bore through the central tubular structure and the second tubular end of the produced tubular insulator of step (b), and a conical shaped pin head bound to the cylindrical shaped pin neck; and said flaring step (c) comprises passing the cylindrical shaped pin neck and the conical shaped pin head into and through the longitudinal bore of the central tubular structure and the second tubular end of the produced tubular insulator of step (b) and passing the funnel-shaped pin shoulder and the cylindrical pin body into the longitudinal bore of the second tubular end of the produced tubular insulator of step (b) until the conical shaped pin head extends into the longitudinal bore of the first tubular end of the produced tubular insulator of step (b).

30. The method of claim 29 wherein said flaring step (c) additionally comprises passing the funnel-shaped pin shoulder and the cylindrical pin body into the longitudinal bore of the second tubular end of the produced tubular insulator of step (b) until the conical shaped pin head and the cylindrical shaped pin neck extend into the longitudinal bore of the first tubular end of the produced tubular insulator of step (b).

31. A method for producing an insulated electrical connector comprising the steps of:

(a) providing an electrical connector comprising a hollow terminal barrel having an outside diameter and including a barrel wall comprising an outside cylindrical surface and an internal cylindrical surface having an internal radius with an internal radius value and with the distance between the internal cylindrical surface and the outside cylindrical surface defining a wall thickness distance;

(b) providing a tubular insulator including a longitudinal tubular structure defining a first tubular end and a second tubular end and a longitudinal bore having an internal bore diameter less than the outside diameter of the terminal barrel and having an internal bore radius with a value ranging from a value less than the internal radius value of the electrical connector in step (a) to about a value equal to the internal radius value plus about 0.80 times the wall thickness distance of the electrical connector in step (a);

(c) flaring the first tubular end of the tubular insulator;

(d) forming a funnel-shaped opening in the second tubular end of the tubular insulator; and (e) inserting the hollow terminal barrel of the electrical connector into the flared first tubular end of the tubular insulator to produce an insulated electrical connector.

32. The method of claim 31 wherein said funnel-shaped opening in the second tubular end comprises an inwardly tapering bore terminating in a bore opening having a bore radius essentially equal to the internal bore radius of the tubular insulator.

33. The method of claim 31 wherein said hollow terminal barrel of the electrical connector terminates in a leading barrel perimeter; and said flared first tubular end of said tubular insulator of step (c) has a first longitudinal bore that terminates in an insulator surface that is generally normal to said first longitudinal bore of said tubular end; and said inserting step (e) further comprises inserting the hollow terminal barrel of the electrical connector into the first longitudinal bore of the flared first tubular end until the leading barrel perimeter is in proximity to the insulator surface and the insulator surface extends over the leading barrel perimeter.

34. The method of claim 33 additionally comprising disposing, prior to said flaring step (c), said tubular insulator of step (b) in a recess of an alignment wheel such that the longitudinal axis of the tubular insulator of step (b) is generally vertical; rotating, prior to said flaring step (c), the alignment wheel, with the step (b) tubular insulator being disposed in said recess of said alignment wheel and while the longitudinal axis of the step (b) tubular insulator remains generally vertical, until the tubular insulator of step (b) reaches a first location where said flaring step (c) is performed while the longitudinal axis of the tubular insulator remains generally vertical; rotating, subsequent to said flaring step (c) and prior to said flaring step (d), the alignment wheel, with the step (c) tubular insulator remaining disposed in said recess of said alignment wheel and while the longitudinal axis of the step (c) tubular insulator remains generally vertical, until the tubular insulator of step (c) reaches a second location which is essentially at the same elevation as the first location and is where said flaring step (d) is performed while the longitudinal axis of the tubular insulator remains generally vertical; rotating, subsequent to said forming step (d) and prior to said inserting step (e), the alignment wheel, with the step (d) tubular insulator remaining disposed in said recess of said alignment wheel and while the longitudinal axis of the step (d) tubular insulator remains generally vertical, until the tubular insulator of step (d) reaches a third location which is essentially at the same elevation as the second location and is where said inserting step (e) is performed while the longitudinal axis of the tubular insulator remains generally vertical.

35. The method of claim 33 additionally comprising providing, prior to said forming step (d), a flare pin comprising a cylindrical pin body, a funnel-shaped pin shoulder integrally bound to the cylindrical pin body, a cylindrical shaped pin neck integrally bound to the funnel-shaped pin shoulder, and a conical shaped pin head bound to the cylindrical shaped pin neck; and said forming step (d) comprises passing the cylindrical shaped pin neck and the conical shaped pin head into and through the second tubular end of the tubular insulator of step (c) and passing the funnel-shaped pin shoulder and the cylindrical pin body into the second tubular end of the tubular insulator of step (c).

36. The method of claim 33 additionally comprising disposing, prior to said flaring step (c), said tubular insulator of step (b) in a recess of an alignment wheel such that the longitudinal axis of the tubular insulator of step (b) is generally vertical; rotating, prior to said flaring step (c), the alignment wheel, with the step (b) tubular insulator being disposed in said recess of said alignment wheel and while the longitudinal axis of the step (b) tubular insulator remains generally vertical, until the tubular insulator of step (b) reaches a first location where said flaring step (c) is performed while the longitudinal axis of the tubular insulator remains generally vertical; rotating, subsequent to said flaring step (c) and prior to said flaring step (d), the alignment wheel, with the step (c) tubular insulator remaining disposed in said recess of said alignment wheel and while the longitudinal axis of the step (c) tubular insulator remains generally vertical, until the tubular insulator of step (c) reaches a second location which is essentially at the same elevation as the first location and is where said flaring step (d) is performed while the longitudinal axis of the tubular insulator remains generally vertical; rotating, subsequent to said forming step (d) and prior to said inserting step (e), the alignment wheel, with the step (d) tubular insulator remaining disposed in said recess of said alignment wheel and while the longitudinal axis of the step (d) tubular insulator remains generally vertical, until the tubular insulator of step (d) reaches a third location which is essentially at the same elevation as the second location and is where said inserting step (e) is performed while the longitudinal axis of the tubular insulator remains generally vertical.

37. The method of claim 36 additionally comprising providing, prior to said forming step (d), a flare pin comprising a cylindrical pin body, a funnel-shaped pin shoulder integrally bound to the cylindrical pin body, a cylindrical shaped pin neck integrally bound to the funnel-shaped pin shoulder, and a conical shaped pin head bound to the cylindrical shaped pin neck; and said forming step (d) comprises passing the cylindrical shaped pin neck and the conical shaped pin head into and through the second tubular end of the tubular insulator of step (c) and passing the funnel-shaped pin shoulder and the cylindrical pin body into the second tubular end of the tubular insulator of step (c).

38. The method of claim 31 additionally comprising providing, prior to said forming step (d), a flare pin comprising a cylindrical pin body, a funnel-shaped pin shoulder integrally bound to the cylindrical pin body, a cylindrical shaped pin neck integrally bound to the funnel-shaped pin shoulder, and a conical shaped pin head bound to the cylindrical shaped pin neck; and said forming step (d) comprises passing the cylindrical shaped pin neck and the conical shaped pin head into and through the second tubular end of the tubular insulator of step (c) and passing the funnel-shaped pin shoulder and the cylindrical pin body into the second tubular end of the tubular insulator of step (c).

39. A method for producing an insulated electrical connector comprising the steps of:

(a) providing an electrical connector comprising a hollow terminal barrel having an outside diameter;

(b) providing a tubular insulator including a longitudinal tubular structure defining a first tubular end, a second tubular end, and a longitudinal bore having an internal bore diameter that is less than the outside diameter of the terminal barrel;

(c) flaring the first tubular end of the tubular insulator;

(d) forming in the second tubular end a funnel-shaped opening comprising an inwardly tapering bore terminating in a bore opening having a bore diameter that is essentially equal to the internal bore diameter of the tubular insulator; and (e) inserting the hollow terminal barrel of the electrical connector into the flared first tubular end such that the bore opening is coaxial with the hollow terminal barrel to produce an insulated electrical connector.

40. The method of claim 39 wherein said hollow terminal barrel of said electrical connector additionally has an internal diameter, and said internal bore diameter of said longitudinal bore is essentially equal to the internal diameter of the terminal barrel.

41. The method of claim 39 wherein said hollow terminal barrel of the electrical connector terminates in a leading barrel perimeter; and said flared first tubular end of said tubular insulator of step (c) has a first longitudinal bore that terminates in an insulator surface that is generally normal to said first longitudinal bore of said tubular end; and said inserting step (e) further comprises inserting the hollow terminal barrel of the electrical connector into the first longitudinal bore of the flared first tubular end until the leading barrel perimeter is in proximity to the insulator surface and the insulator surface extends over the leading barrel perimeter.

42. The method of claim 41 additionally comprising disposing, prior to said flaring step (c), said tubular insulator of step (b) in a recess of an alignment wheel such that the longitudinal axis of the tubular insulator of step (b) is generally vertical; rotating, prior to said flaring step (c), the alignment wheel, with the step (b) tubular insulator being disposed in said recess of said alignment wheel and while the longitudinal axis of the step (b) tubular insulator remains generally vertical, until the tubular insulator of step (b) reaches a first location where said flaring step (c) is performed while the longitudinal axis of the tubular insulator remains generally vertical; rotating, subsequent to said flaring step (c) and prior to said flaring step (d), the alignment wheel, with the step (c) tubular insulator remaining disposed in said recess of said alignment wheel and while the longitudinal axis of the step (c) tubular insulator remains generally vertical, until the tubular insulator of step (c) reaches a second location which is essentially at the same elevation as the first location and is where said flaring step (d) is performed while the longitudinal axis of the tubular insulator remains generally vertical; rotating, subsequent to said forming step (d) and prior to said inserting step (e), the alignment wheel, with the step (d) tubular insulator remaining disposed in said recess of said alignment wheel and while the longitudinal axis of the step (d) tubular insulator remains generally vertical, until the tubular insulator of step (d) reaches a third location which is essentially at the same elevation as the second location and is where said inserting step (e) is performed while the longitudinal axis of the tubular insulator remains generally vertical.

43. The method of claim 41 additionally comprising providing, prior to said forming step (d), a flare pin comprising a cylindrical pin body, a funnel-shaped pin shoulder integrally bound to the cylindrical pin body, a cylindrical shaped pin neck integrally bound to the funnel-shaped pin shoulder, and a conical shaped pin head bound to the cylindrical shaped pin neck; and said forming step (d) comprises passing the cylindrical shaped pin neck and the conical shaped pin head into and through the second tubular end of the tubular insulator of step (c) and passing the funnel-shaped pin shoulder and the cylindrical pin body into the second tubular end of the tubular insulator of step (c).

44. The method of claim 41 additionally comprising disposing, prior to said flaring step (c), said tubular insulator of step (b) in a recess of an alignment wheel such that the longitudinal axis of the tubular insulator of step (b) is generally vertical; rotating, prior to said flaring step (c), the alignment wheel, with the step (b) tubular insulator being disposed in said recess of said alignment wheel and while the longitudinal axis of the step (b) tubular insulator remains generally vertical, until the tubular insulator of step (b) reaches a first location where said flaring step (c) is performed while the longitudinal axis of the tubular insulator remains generally vertical; rotating, subsequent to said flaring step (c) and prior to said flaring step (d), the alignment wheel, with the step (c) tubular insulator remaining disposed in said recess of said alignment wheel and while the longitudinal axis of the step (c) tubular insulator remains generally vertical, until the tubular insulator of step (c) reaches a second location which is essentially at the same elevation as the first location and is where said flaring step (d) is performed while the longitudinal axis of the tubular insulator remains generally vertical; rotating, subsequent to said forming step (d) and prior to said inserting step (e), the alignment wheel, with the step (d) tubular insulator remaining disposed in said recess of said alignment wheel and while the longitudinal axis of the step (d) tubular insulator remains generally vertical, until the tubular insulator of step (d) reaches a third location which is essentially at the same elevation as the second location and is where said inserting step (e) is performed while the longitudinal axis of the tubular insulator remains generally vertical.

45. The method of claim 44 additionally comprising providing, prior to said forming step (d), a flare pin comprising a cylindrical pin body, a funnel-shaped pin shoulder integrally bound to the cylindrical pin body, a cylindrical shaped pin neck integrally bound to the funnel-shaped pin shoulder, and a conical shaped pin head bound to the cylindrical shaped pin neck; and said forming step (d) comprises passing the cylindrical shaped pin neck and the conical shaped pin head into and through the second tubular end of the tubular insulator of step (c) and passing the funnel-shaped pin shoulder and the cylindrical pin body into the second tubular end of the tubular insulator of step (c).

46. The method of claim 39 additionally comprising providing, prior to said forming step (d), a flare pin comprising a cylindrical pin body, a funnel-shaped pin shoulder integrally bound to the cylindrical pin body, a cylindrical shaped pin neck integrally bound to the funnel-shaped pin shoulder, and a conical shaped pin head bound to the cylindrical shaped pin neck; and said forming step (d) comprises passing the cylindrical shaped pin neck and the conical shaped pin head into and through the second tubular end of the tubular insulator of step (c) and passing the funnel-shaped pin shoulder and the cylindrical pin body into the second tubular end of the tubular insulator of step (c).

* * * * *